US006424298B1

(12) United States Patent
Nishikawa et al.

(10) Patent No.: US 6,424,298 B1
(45) Date of Patent: Jul. 23, 2002

(54) MICROSTRIP ARRAY ANTENNA

(75) Inventors: Kunitoshi Nishikawa; Hideo Iizuka; Toshiaki Watanabe, all of Aichi-ken (JP)

(73) Assignee: Kabushiki Kaisha Toyota Chuo Kenkyusho, Aichi-gun (JP)

( * ) Notice: Subject to any disclaimer, the term of this patent is extended or adjusted under 35 U.S.C. 154(b) by 0 days.

(21) Appl. No.: 09/576,443

(22) Filed: May 22, 2000

(30) Foreign Application Priority Data

May 21, 1999 (JP) ..... 11-141170
Feb. 29, 2000 (JP) ..... 2000-54606

(51) Int. Cl.[7] ..... H01Q 1/38
(52) U.S. Cl. ..... 343/700 MS
(58) Field of Search ..... 343/700 MS; H01Q 1/38

(56) References Cited

U.S. PATENT DOCUMENTS

| | | | |
|---|---|---|---|
| 3,995,277 A | 11/1976 | Olyphant, Jr. | 343/846 |
| 4,063,245 A | 12/1977 | James et al. | 343/700 MS |
| 4,173,019 A | 10/1979 | Williams | 343/700 MS |
| 4,203,116 A | 5/1980 | Lewin | 343/700 MS |
| 4,833,482 A | 5/1989 | Trinh et al. | 343/700 MS |

FOREIGN PATENT DOCUMENTS

| | | |
|---|---|---|
| EP | 0 606 514 | 7/1994 |
| JP | 55-4147 | 12/1980 |
| JP | 7-86826 | 3/1995 |

OTHER PUBLICATIONS

J. P. Daniel, et al., "Design of Low Cost Printed Antenna Arrays", Institute of Electronics, Information and Communication Engineers, Aug. 1985, pp. 380–383.

*Primary Examiner*—Michael C. Wimer
(74) *Attorney, Agent, or Firm*—Oblon, Spivak, McClellend, Maier & Neustadt, P.C.

(57) ABSTRACT

Ten radiation antenna elements project from a straight feeder stripline. A first set of radiation antenna elements each having a rectangular shape project from a first side edge of the feeder stripline such that the radiation antenna elements incline at an angle of about 45 degrees. The distance between adjacent radiation antenna elements is equal to an guide wavelength $\lambda_g$ and the length of each radiation antenna element is equal to $\lambda_g/2$. Similarly, a second set of radiation antenna elements each having a rectangular shape project from a second side edge of the feeder stripline. Each of the radiation antenna elements in the second set is disposed to be separated by $\lambda_g/2$ from a corresponding one of the radiation antenna elements in the first set. Each of the radiation antenna elements is connected to the corresponding side edge of the feeder stripline via a corner thereof.

30 Claims, 27 Drawing Sheets

MICROSTRIP ARRAY ANTENNA

BACKGROUND OF THE INVENTION

1. Field of the Invention

The present invention relates to a planar array antenna formed of a microstrip conductor and capable of being used as a transmission/reception antenna of a radar mounted on a vehicle.

2. Description of the Related Art

U.S. Pat. No. 4,063,245 discloses a conventional planar array antenna formed of a microstrip conductor. As shown in FIG. 18, in the antenna disclosed in U.S. Pat. No. 4,063,245, a ground conductor layer 2 is formed on a reverse surface of a dielectric substrate 1, and a plurality of straight feeder microstrips 3 are formed on the dielectric substrate 1. The feeder microstrips 3 extend in parallel to each other and have first ends connected together and second ends of open-circuit termination (hereinafter referred to as "open ends"). A plurality of antenna elements 4*a* to 4*e* project transversely from each feeder microstrip 3 in the form of branches. Thus, a linear array is formed. The feeder microstrips 3 each forming a linear array are connected to a feeder microstrip 5, and a composite signal is output from the center 6 of the feeder strip 5. Thus, a two-dimensional array antenna is configured.

The antenna elements 4*a* to 4*e* are disposed at a pitch corresponding to the guide wavelength $\lambda_g$ of electromagnetic waves that propagate within the feeder microstrip (hereinafter simply referred to as the "guide wavelength"), and the length of the antenna elements 4*a* to 4*e* is set to about half the guide wavelength $\lambda_g$; i.e., $\lambda_g/2$.

Since the excitation amplitude of each of the antenna elements 4*a* to 4*e* can be controlled through a change in the width thereof, the antenna can have desired directivity-related characteristics; i.e., gain and side lobe level, which are determined in accordance with the intended use (specifications). In the illustrated example, antenna elements nearer either end of each feeder microstrip 3, such as 4*a* and 4*e*, are narrower than those nearer the center of the feeder microstrip 3, such as 4*c*; and the antenna element 4*e* is connected to the feeder microstrip 3 at a point half the guide wavelength $\lambda_g$ from the open end 7 of the feeder microstrip 3. Thus, standing-wave excitation is enabled, and each linear array can have a peak-like amplitude distribution such that the amplitude increases toward the center of the feeder microstrip 3. This amplitude distribution has the effect of shrinking side lobes.

FIG. 19 is a plan view showing the structure of another conventional array antenna. This array antenna comprises a straight feeder microstrip 53 as in the above-described conventional antenna, and a plurality of antenna elements 54*a* to 54*t* projecting transversely from the feeder microstrip 53 in the form of branches. One end of the feeder microstrip 53 is connected to an input/output port 56, and the other end is connected to a matching termination element 58*a*, whereby traveling-wave excitation is realized. The antenna elements 54*a* to 54*j* in a first set project perpendicularly from one side of the feeder microstrip 53 at a pitch corresponding to the guide wavelength $\lambda_g$. Further, the antenna elements 54*k* to 54*t* in a second set project perpendicularly from the other side of the feeder microstrip 53 at a pitch corresponding to the guide wavelength $\lambda_g$. The positions at which the antenna elements 54*a* to 54*j* in the first set are connected to the feeder microstrip 53 are offset by $\lambda_g/2$ from the positions at which the antenna elements 54*k* to 54*t* in the second set are connected to the feeder microstrip 53.

The above-described structure makes it possible to increase the number of antenna elements within a unit path length and to reduce the residual power reaching the terminal end, which residual power lowers the efficiency of an antenna which has a relatively short array length and is excited by traveling waves. Therefore, the structure can realize an antenna which operates efficiently even when the array length is relatively short (about $10\lambda_g$ in the antenna shown in FIG. 19). Further, in the conventional antennas shown in FIGS. 18 and 19, the antenna elements 4*a* to 4*e* or the antenna elements 54*a* to 54*t* radiate electromagnetic waves mainly from their open ends and can therefore be considered to approximate magnetic dipoles. Therefore, radiated or received electromagnetic waves have a plane of polarization perpendicular to the feeder microstrip 3 or 53.

Moreover, an antenna as shown in FIG. 20 is known. In this antenna, antenna elements 74*a* to 74*e* are formed to incline with respect to a feeder strip 73 such that the antenna elements 74*a*, 74*b*, and 74*c* located on one side of the feeder strip 73 incline at an angle of about +45 degrees with respect to the feeder strip, and the antenna elements 74*d* and 74*e* located on the other side of the feeder strip 73 incline at an angle of about −45 degrees with respect to the feeder strip, whereby circularly polarized waves are produced. The antenna elements 74*a* and 74*d* are symmetrical with respect to a line A—A passing through the center of the feeder microstrip 73 and are disposed such that the distance between the antenna elements 74*a* and 74*d* becomes $\lambda_g/4$. In other words, an electric field Ea which is radiated from the antenna element 74*a* at an angle of +45 degrees relative to the feeder microstrip 73 and an electric field Ed which is radiated from the antenna element 74*d* at an angle of −45 degrees relative to the feeder microstrip 73 are composed with a phase difference of 90 degrees, so that circularly polarized waves are radiated mainly in the direction of a main beam.

Moreover, an array antenna having a structure as shown in FIGS. 21A and 21B is described in "Design of Low Cost Printed Antenna Arrays" (J. P. Daniel, E. Penard, M. Nedelec, and J. P. Mutzig, Proc. ISAP, pp. 121–124, Aug. 1985). On a dielectric substrate 101 (201) are disposed 10 square microstrip antenna elements 104 (204) which are connected to a feeder microstrip 103 (203) such that power is fed to the microstrip antenna elements 104 (204) from their corners. The plurality of microstrip antenna elements 104 (204) are disposed symmetrically along the longitudinal direction with respect to an input/output terminal 102 (202) formed at the center of the feeder microstrip 103 (203). In the antenna of FIG. 21A, the microstrip antenna elements 104 are connected to one side edge of the feeder microstrip 103 at a pitch corresponding to the guide wavelength $\lambda_g$ of the feeder microstrip 103, and an impedance transformer 105 having a length of $\lambda_g/4$ is formed on the upstream side (the side closer to the input/output terminal 102) of each connection point. In the antenna of FIG. 21B, the microstrip antenna elements 204 are alternately connected to opposite side edges of the feeder microstrip 203 at a pitch corresponding to half the guide wavelength $\lambda_g$ of the feeder microstrip 203, and an impedance transformer 205 having a length of $\lambda_g/4$ is formed on the upstream side (the side closer to the input/output terminal 202) of each connection point.

By virtue of the above-described structure, in the antenna of FIG. 21A, degenerated $TM_{01}$, and $TM_{10}$, modes perpendicular to the microstrip antenna elements 104 are excited, so that an electromagnetic wave polarized in a direction perpendicular to the feeder microstrip 103 is generated as a composite polarized wave. Similarly, in the antenna of FIG.

21B, an electromagnetic wave polarized in a direction perpendicular to the feeder microstrip 203 is generated. Further, in the antennas of FIGS. 21A and 21B, through adjustment of the conversion impedance of the impedance transformers 105 and 205, the excitation amplitude of each of the microstrip antenna elements 104 and 204 can be controlled in order to attain desired directivity-related characteristics. Further, in the arrangement shown in FIG. 21B, the microstrip antenna elements 204*a* and 204*b* produce respective wave components perpendicular to the main polarized waves (polarized waves perpendicular to the feeder microstrip 203) such that the components are excited in opposite phases and are thus cancelled out. Therefore, the level of cross-polarized waves is reduced.

The above-described microstrip array antennas have the advantages of a thin shape and high productivity, and are therefore widely applied to systems used in the microwave band. Further, in the millimeter-wave band, they are applied to on-vehicle radars for collision prevention or ACC (Adaptive Cruise Control).

In the case of on-vehicle radars, waves linearly polarized at an angle of 45 degrees with respect to the ground must be used in order to avoid interference with waves radiated from a radar mounted on an oncoming vehicle. However, in a conventional antenna, since antenna elements extend vertically from a feeder line regardless of whether the antenna is of standing-wave excitation type or travelling-wave excitation type, only waves polarized in a direction perpendicular to the feeder microstrip can be generated. That is, waves polarized in a desired direction cannot be obtained. Although there has been proposed an arrangement in which antenna elements are disposed on opposite sides of a feeder microstrip such that the antenna elements incline at symmetric angles with respect to the feeder microstrip, the arrangement is adapted to generate a circularly polarized wave and cannot generate a linearly polarized wave.

In the microstrip antennas shown in FIGS. 21A and 21B, power is fed to each microstrip antenna element via a corner thereof, so that degenerated modes are generated as shown in FIG. 22A. Therefore, each microstrip antenna element operates in the same manner as an antenna element shown in FIG. 22B. Accordingly, like the case of the array antennas of FIGS. 18 and 19, only waves polarized in a direction perpendicular to the feeder microstrip can be generated. Further, in these antennas, the excitation amplitude of each microstrip antenna element is controlled by means of an impedance transformer inserted into the feeder microstrip. Therefore, when the impedance is low, the width of the feeder microstrip becomes excessively large, which hinders disposition of microstrip antenna elements. Further, when the impedance is high, the width of the feeder microstrip becomes excessively small, which renders fabrication of the antennas difficult because of limits in relation to fabrication.

SUMMARY OF THE INVENTION

The present invention was accomplished in order to solve the above-described problems, and an object of the present invention is to provide a microstrip array antenna which enables radiation and reception of waves polarized in a direction inclined with respect to a feeder microstrip.

Another object of the present invention is to provide a microstrip array antenna which has excellent reflection characteristics and high radiation efficiency.

In order to achieve the above objects, a microstrip array antenna according to a first aspect of the present invention comprises a dielectric substrate, a strip conductor formed on a top face of the dielectric substrate, and a ground plate formed on a reverse face of the dielectric substrate, wherein the strip conductor comprises a straight feeder stripline, and a plurality of radiation antenna elements disposed along at least one side of the feeder stripline at a predetermined pitch. The radiation antenna elements are connected to the feeder stripline and each have an electric field radiation edge which is not parallel to the longitudinal direction of the feeder stripline. Each of the radiation antenna elements is formed of a strip conductor having a base end connected to said feeder stripline, and an open distal end, and has a length approximately equal to an integral number times half wavelengths of electromagnetic waves which propagate along the feeder stripline at a predetermined operating frequency, and a width determined according to excitation amplitude of respective radiation antenna element, said excitation amplitude being determined so as to provide a desired directivity.

According to a second aspect of the present invention, each of radiation antenna elements has a strip-like shape, so that the width of each radiation antenna element is smaller than the length thereof.

According to a third aspect of the present invention, each of the radiation antenna elements has a rectangular shape and is connected to the feeder stripline via only a corner of the antenna element or a portion in the vicinity of the corner.

According to a fourth aspect of the present invention, the array antenna has a first region in which each of the radiation antenna elements has a comparatively narrow width and a second region in which each of the radiation antenna elements has a comparatively wide width. The radiation antenna element in the first region has a strip-like shape with a constant width and a length larger than the width and is connected to the feeder stripline via the entirety of the base-end side. The radiation antenna element in the second region has a rectangular shape and is connected to the feeder stripline via only a corner of the antenna element or a portion in the vicinity of the corner.

According to a fifth aspect of the present invention, the radiation antenna element having the strip-like shape is used in a region in which each antenna element has a width less than about 0.075 times a free-space wavelength at the operating frequency, and the radiation antenna element having the rectangular shape is used in a region in which each antenna element has a width equal to or greater than about 0.075 times the free-space wavelength at the operating frequency.

According to a sixth aspect of the present invention, the electric field radiation edge of each radiation antenna element forms an angle of about 45 degrees with respect to the feeder stripline.

According to a seventh aspect of the present invention, each of the radiation antenna elements has a rectangular shape in which the length differs from the width.

According to an eighth aspect of the present invention, each of the sides of each rectangular radiation antenna element which form the corner connected to the feeder stripline forms an angle of about 45 degrees with respect to the feeder stripline.

According to a ninth aspect of the present invention, the radiation antenna elements comprise first radiation antenna elements formed along a first side of the feeder stripline and second radiation antenna elements formed along a second side of the feeder stripline opposite the first side. The second radiation antenna elements have the same shape as that of the first radiation antenna elements and are disposed substantially in parallel to the first radiation antenna elements.

According to a tenth aspect of the present invention, the first radiation antenna elements formed along the first side of the feeder stripline radiate electric fields in a direction substantially parallel to a direction in which the second radiation antenna elements formed along the second side of the feeder stripline radiate electric fields.

According to an eleventh aspect of the present invention, each of the second radiation antenna elements is disposed at an approximately center point between adjacent first radiation antenna elements disposed along the feeder stripline.

In the microstrip array antenna according to the present invention, a plurality of radiation antenna elements are connected to at least one side of the feeder stripline at a predetermined pitch such that the electric field radiation edge of each antenna element inclines at a certain angle with respect to the longitudinal direction of the feeder stripline. Therefore, electric fields produced perpendicular to the electric field radiation edge generate electromagnetic waves polarized in a direction which is not perpendicular to the feeder stripline but which inclines with respect to the feeder stripline. Accordingly, when the microstrip array antenna is used as an antenna of a radar for automotive use, the antenna does not receive electromagnetic waves from oncoming vehicles. Further, the microstrip array antenna can have a desired directivity through a proper design in which the width of each radiation antenna element is changed in accordance with a desired excitation amplitude.

The term "electric field radiation edge" of the radiation antenna element means a side of the radiation antenna element perpendicular to the direction of an electric field to be radiated.

In the second aspect of the present invention, since each radiation antenna element has a strip-like shape, such that the width of each radiation antenna element is smaller than the length thereof, polarized waves of a single mode can be obtained.

In the third aspect of the present invention, each radiation antenna element has a rectangular shape and is connected to the feeder stripline via only a corner of the antenna element or a portion in the vicinity of the corner. Therefore, opposite sides of each radiation antenna element parallel to the longitudinal direction thereof have substantially the same length. This enables generation of electromagnetic waves of a single mode polarized in the longitudinal direction to thereby obtain excellent directivity while lowering the level of cross-polarized waves. Accordingly, when the microstrip array antenna is used as an antenna of a radar for automotive use, the antenna does not receive electromagnetic waves from oncoming vehicles. Further, since the reflection of each radiation antenna element is reduced, the radiation efficiency or reception sensitivity of the array antenna can be increased. Further, a desired directivity can be obtained through a design in which the width of the radiation antenna element is changed in accordance with its position on the feeder stripline.

In the fourth aspect of the present invention, each radiation antenna element has a certain shape and is connected to the feeder stripline in a certain manner, the shape and the manner of connection being determined in accordance with the width of the radiation antenna element—which changes in accordance with position on the feeder stripline in order to obtain a desired directivity. Thus, there can be realized an array antenna in which reflection at each element is minimized. Therefore, it becomes possible to fabricate an array antenna having a high radiation efficiency or reception sensitivity.

In the fifth aspect of the present invention, a radiation antenna element having the strip-like shape is used in a region of the width distribution in which each antenna element has a width less than about 0.075 times a free-space wavelength at the operating frequency, and a radiation antenna element having a rectangular shape is used in a region of the width distribution in which each antenna element has a width equal to or greater than about 0.075 times the free-space wavelength at the operating frequency. Thus, each radiation antenna element has desirable reflection characteristics, which enables production of high-efficiency array antennas having different directivities.

In the sixth aspect of the present invention, since the electric field radiation edge of each radiation antenna element forms an angle of about 45 degrees with respect to the feeder stripline, the microstrip array antenna can generate electromagnetic waves which are polarized at an angle of about 45 degrees with respect to the feeder stripline. Therefore, when the microstrip array antenna is mounted on a vehicle such that the feeder stripline extends perpendicular to the ground surface and is used as an antenna of a radar, reception of electromagnetic waves from oncoming vehicles can be prevented most effectively.

In the seventh aspect of the present invention, each of the radiation antenna elements has a non-square, rectangular shape such that the length differs from the width. This structure suppresses excitation of other modes more effectively, to thereby facilitate generation of waves of a single mode.

In the eighth aspect of the present invention, each of the sides of each rectangular radiation antenna element which form the corner connected to the feeder stripline forms an angle of about 45 degrees with respect to the feeder stripline. Therefore, electromagnetic waves can be polarized at an angle of about 45 degrees with respect to the feeder stripline, so that the same effect as that obtained in the sixth aspect can be obtained.

In the ninth aspect of the present invention, since the radiation antenna elements are disposed on both sides of the feeder stripline such that all the radiation antenna elements are directed toward the same direction, the microstrip array antenna can have improved electromagnetic-wave radiation efficiency and improved reception sensitivity.

In the tenth aspect of the present invention, since the first and second radiation antenna elements have the same direction of polarization in which electromagnetic waves are polarized, the microstrip array antenna can have improved electromagnetic-wave radiation efficiency and improved reception sensitivity.

In the eleventh aspect of the present invention, since the radiation antenna elements are alternately disposed along both sides of the feeder stripline at equal intervals, the microstrip array antenna can radiate and receive electromagnetic waves with high efficiency and has improved directivity.

DESCRIPTION OF THE PREFERRED EMBODIMENTS

Embodiments of the present invention will be described with reference to the drawings.

Figure 1:
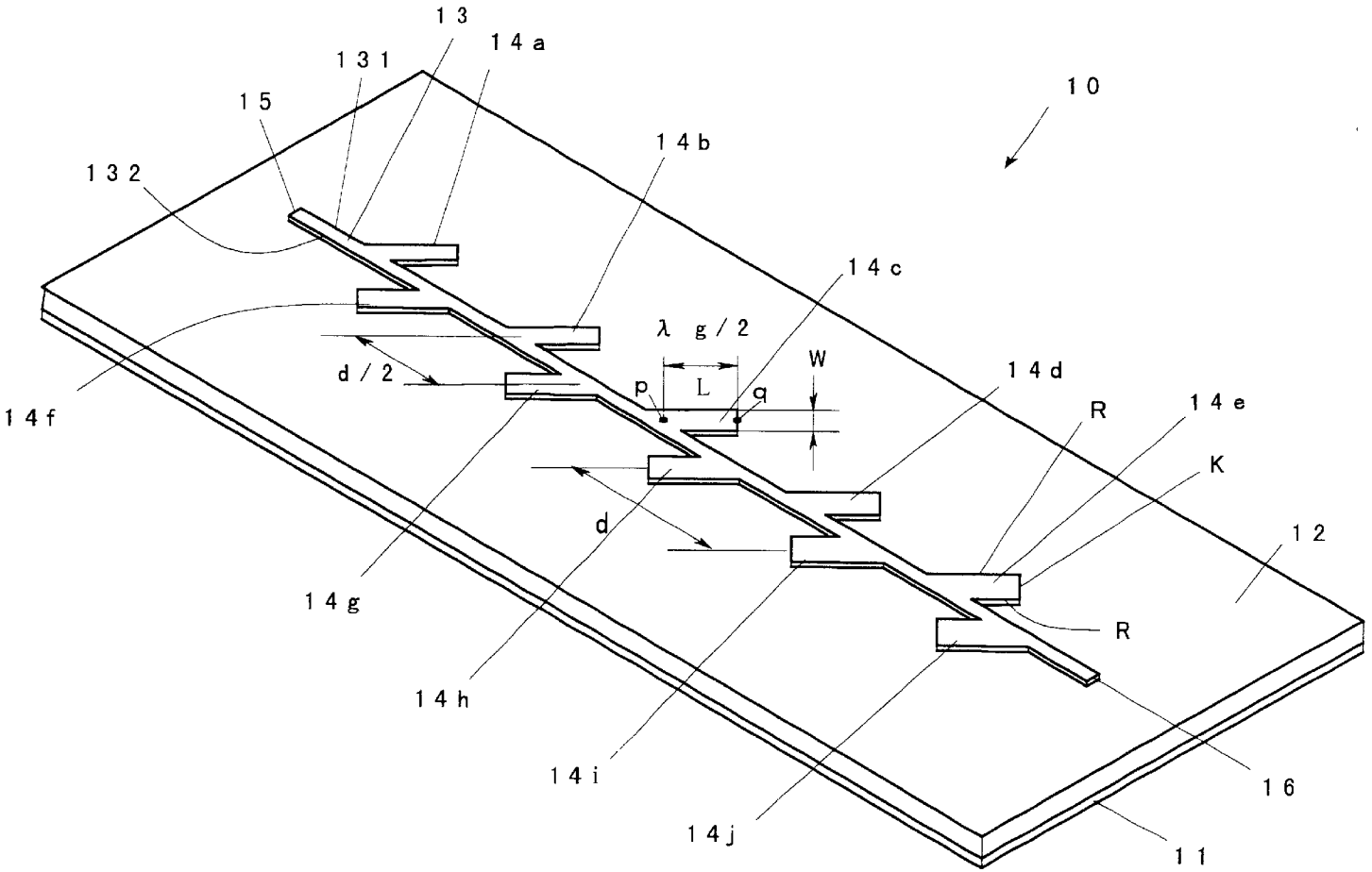
FIG. 1 is a perspective view showing the structure of a microstrip array antenna according to a first embodiment of the present invention.
Figure 2A:
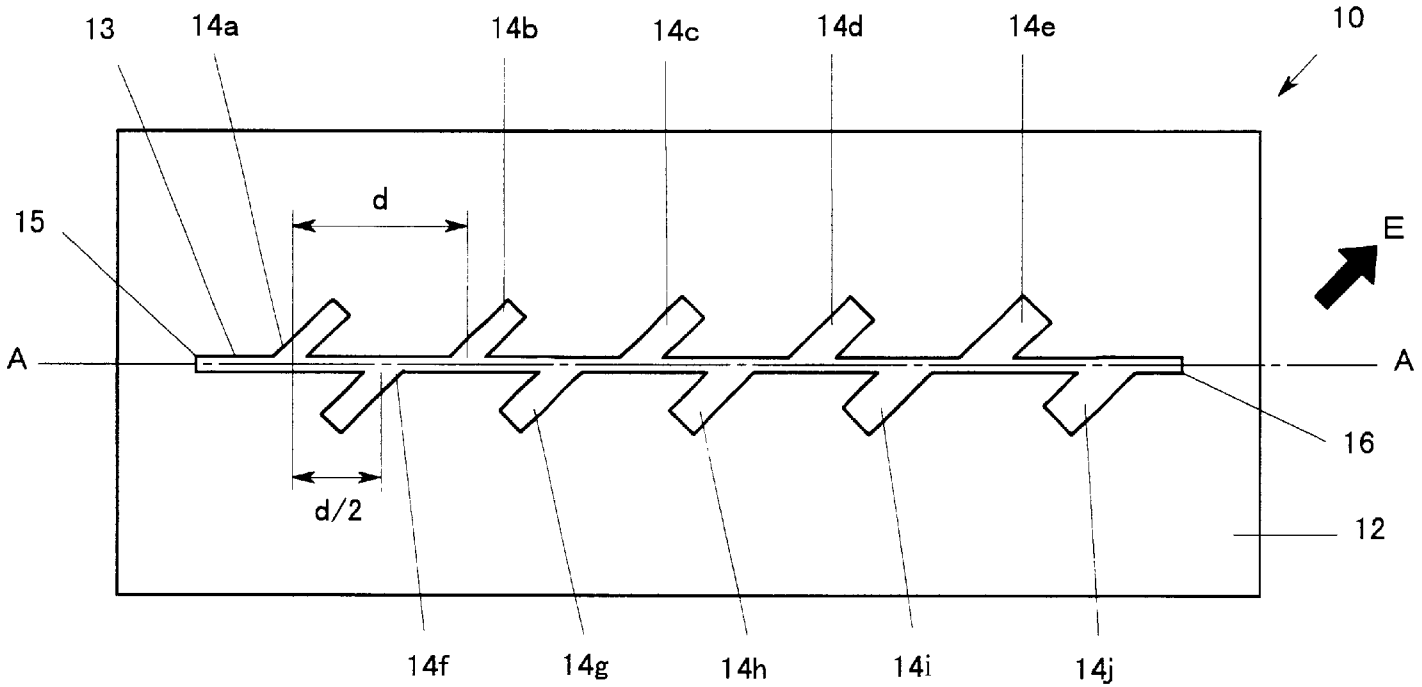
FIGS. 2A and 2B are plan and sectional views, respectively, of the microstrip array antenna according to the first embodiment.
Figure 2B:
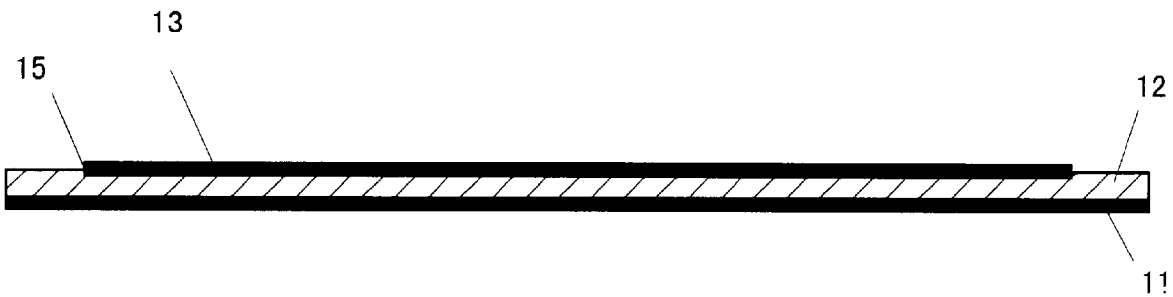

FIG. 1 shows a microstrip array antenna 10 according to a first embodiment of the present invention (claims 1, 2, 6, 9 and 10); FIG. 2A is a plan view of the microstrip array antenna 10; and FIG. 2B is a sectional view taken along line A—A of FIG. 2A. A ground conductor layer (ground plate) 11 is formed on a reverse face of a dielectric substrate 12; and a straight feeder stripline 13 and ten radiation antenna elements 14*a* to 14*j* projecting from the stripline 13 are formed on a top face of the dielectric substrate 12.

On the dielectric substrate 12, a first set of radiation antenna elements 14*a* to 14*e* each having a strip-like shape project from a first side edge 131 of the feeder stripline 13 such that the radiation antenna elements 14*a* to 14*e* incline at an angle of about 45 degrees with respect to the feeder stripline 13. The distance d between adjacent radiation antenna elements corresponds to an guide wavelength $\lambda_g$ of the feeder stripline 13 at an operating frequency, and the length (distance from the center p of the connected portion to the open end q) of each radiation antenna element is set to about half the guide wavelength $\lambda_g$. The sides at the open ends of the projected radiation antenna elements 14*a* to 14*e* in the first set are parallel to each other and each form an angle of about +45 degrees with respect to the feeder stripline 13. Similarly, a second set of radiation antenna elements 14*f* to 14*j* each having a strip-like shape project from a second side edge 132 of the feeder stripline 13 in parallel to the radiation antenna elements 14*a* to 14*e* in the first set. The sides at the open ends of the projected radiation antenna elements 14*f* to 14*j* in the second set are parallel to each other, each form an angle of about −135 degrees with respect to the feeder stripline 13, and are parallel to the sides at the open ends of the radiation antenna elements 14*a* to 14*e* in the first set. Each of the radiation antenna elements 14*f* to 14*j* in the second set is disposed to be separated by, for example, d/2 from a corresponding one of the radiation antenna elements 14*a* to 14*e* in the first set. One of sides constituting the contour of each radiation element serves as an electric field radiation edge. In the present embodiment, side K serves as an electric field radiation edge; however, another side R may be used as an electric field radiation edge. Either of the sides K and R operates as an electric field radiation edge depending on the operating frequency. The direction of the electric field of a radiated wave is perpendicular to the electric field radiation edge.

Figure 3:
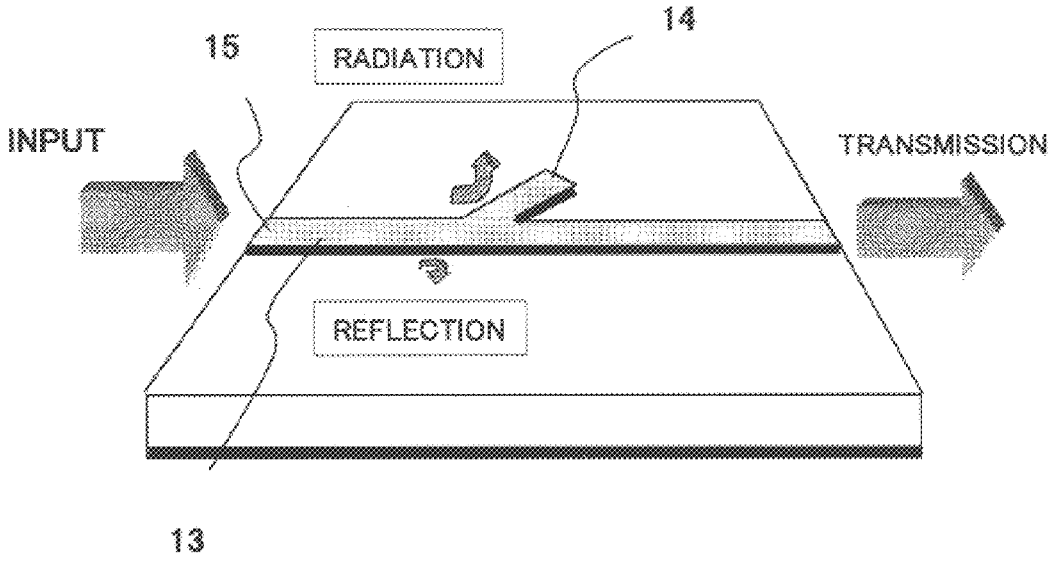
FIG. 3 is a view showing the principle of operation of a radiation antenna element of the microstrip array antenna according to the present invention.

A portion of electrical power input from an input terminal 15 is sequentially fed to the radiation antenna elements 14*a*, 14*f*, 14*b*, etc. and is radiated therefrom, and the remaining electrical power propagates in a traveling direction (rightward in FIGS. 2A and 2B) while attenuating gradually and finally reaches a termination end 16. FIG. 3 schematically shows the operation of a single radiation antenna element 14. A portion of electrical power fed from the input terminal (from the left side in FIG. 3) is fed to the antenna element 14 and is radiated therefrom, and a greater portion of the remaining electrical power transmits to the output terminal (to the right side in FIG. 3). Due to impedance mismatch, a portion of the electrical power is reflected and returns to the input terminal. That is, the amount of electrical power radiated from the antenna element can be represented by the equation "Radiation=Input—Transmission—Reflection," and is univocally determined when transmission and reflections of the radiation antenna element for the input are obtained. When the reflection is very small as compared with radiation and transmission, the relationship "Radiation≈Input—Transmission" holds. In this case, the radiation is univocally determined when only the transmission is obtained.

Figure 4:
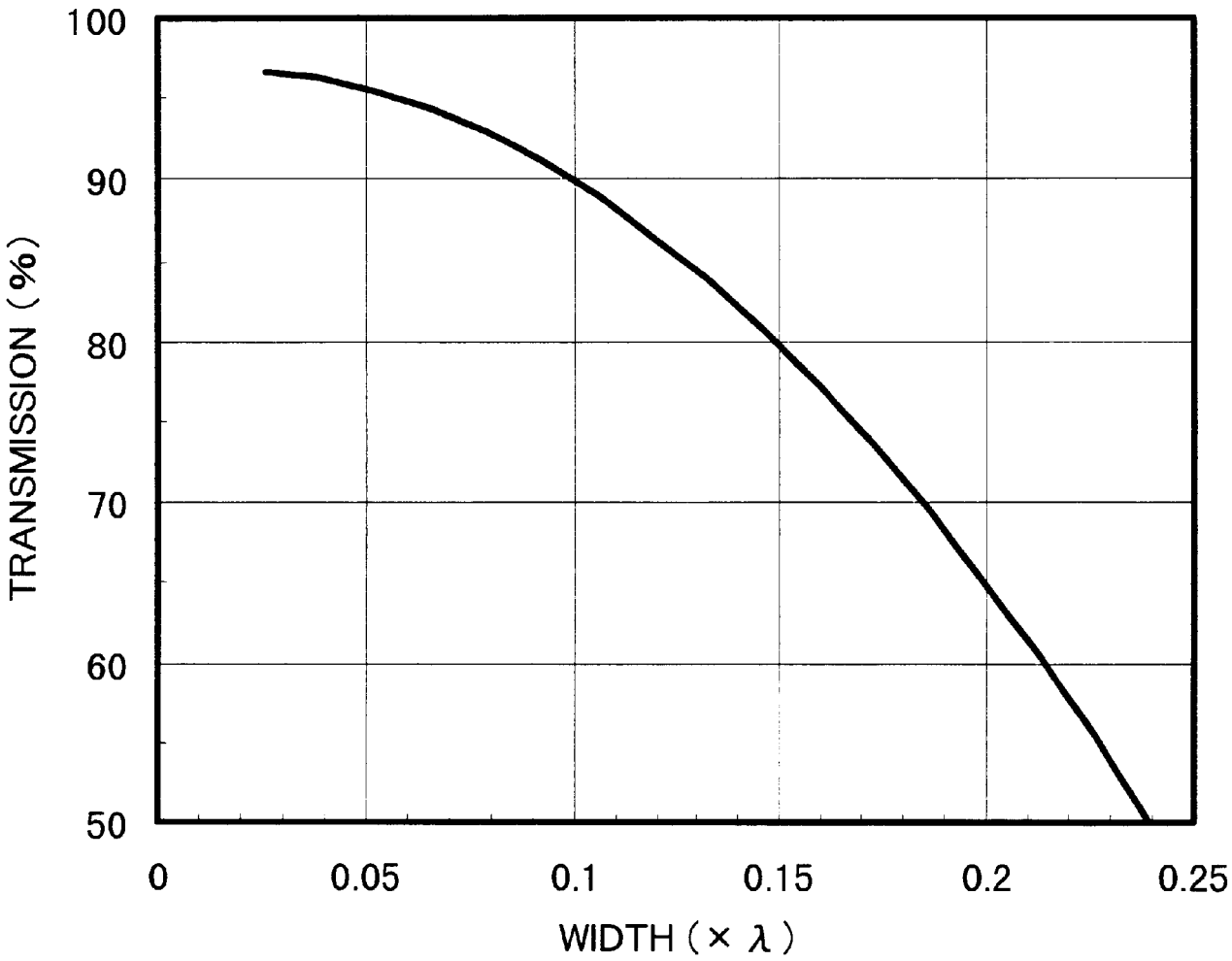
FIGS. 4 to 6 are graphs showing characteristics of a radiation antenna element of the microstrip array antenna according to the first embodiment.
Figure 5:
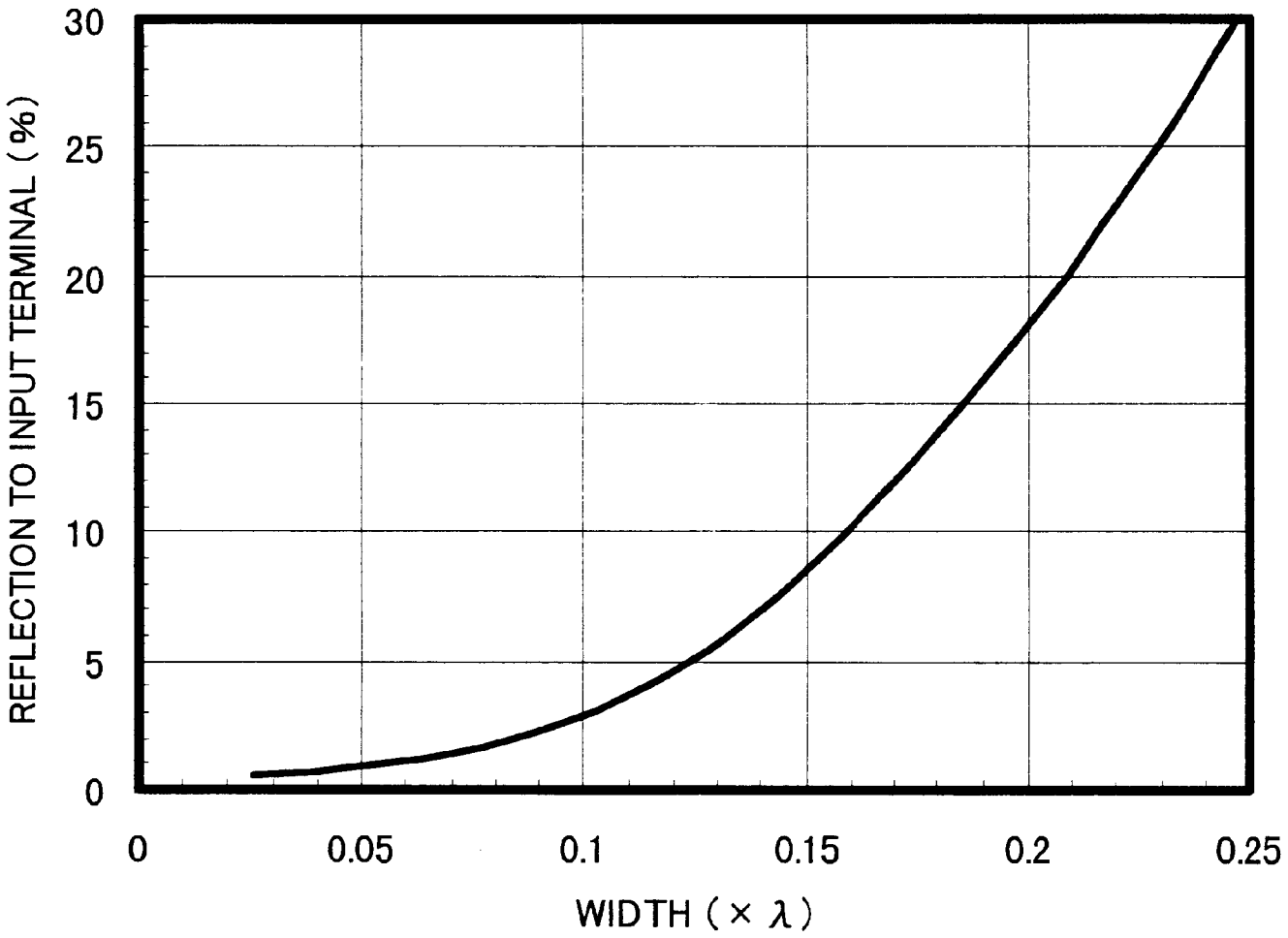
Figure 6:
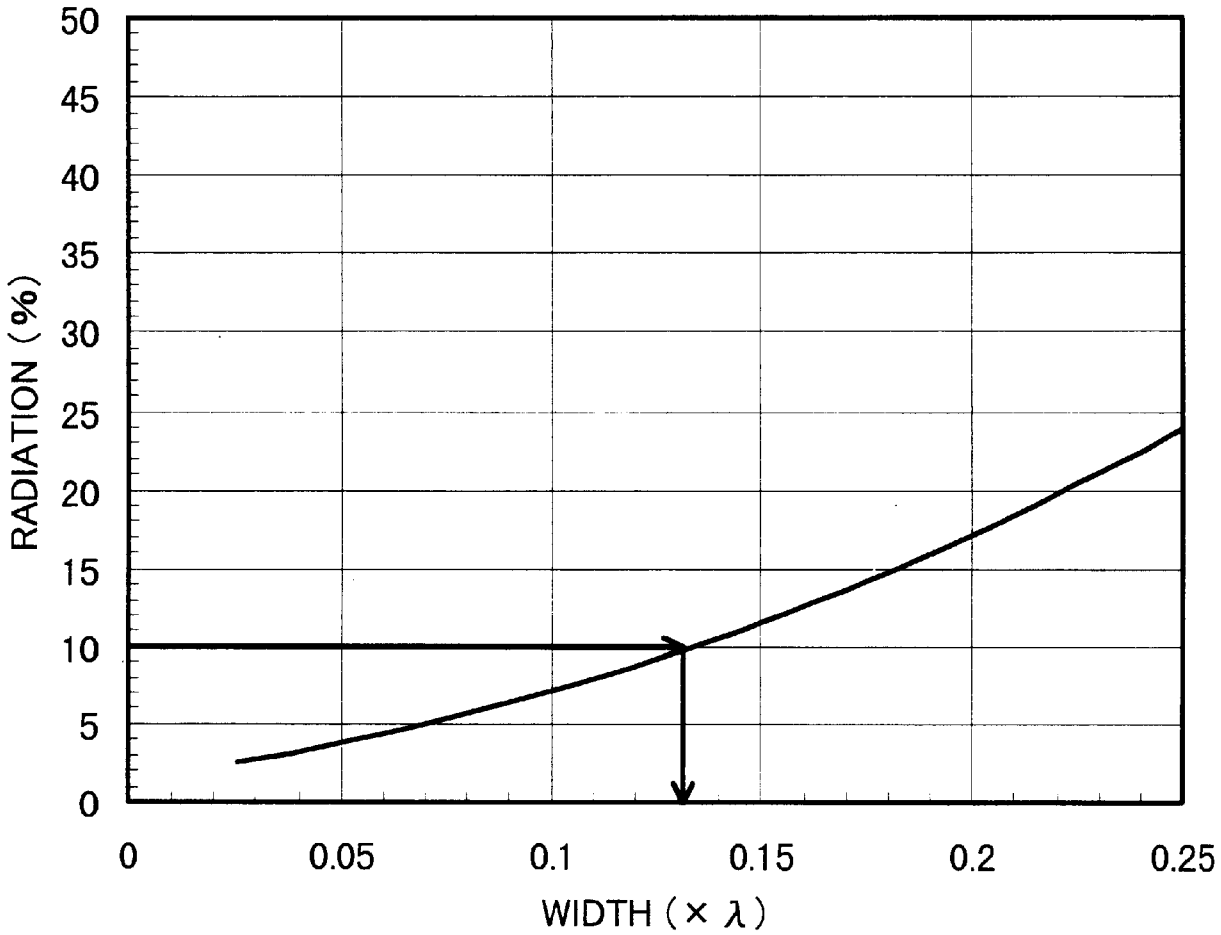

FIGS. 4 and 5 show variations in transmission and reflection when the width of the radiation antenna element 14 is changed. In FIG. 4, the horizontal axis represents the width of the radiation antenna element 14 as normalized with respect to a free-space wavelength λ at the operating frequency, and the vertical axis represents electrical power transmitted to the output terminal as a percentage of input. Similarly, in FIG. 5, the horizontal axis represents the width of the radiation antenna element 14 as normalized with respect to the free-space wavelength λ at the operating frequency, and the vertical axis represents electrical power reflected to the input terminal as a percentage of input. Also, FIG. 6 shows the radiation of the radiation antenna element obtained by use of the above-described equation. FIG. 6 enables determination of a width of a radiation antenna element required for obtaining a desired excitation amplitude (radiation). For example, when a radiation antenna element must radiate 10% of input power, the width of the radiation antenna element is set to 0.13 λ. During the course of designing the antenna shown in FIG. 1, the width of each radiation antenna element is determined in accordance with a desired excitation amplitude (radiation) in order to obtain a desired directivity.

Figure 7A:
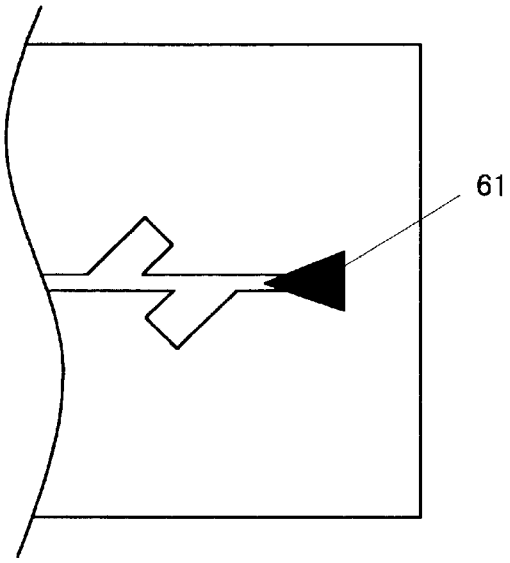
FIGS. 7A and 7B are plan views each showing the termination portion of the feeder stripline of the microstrip array antenna according to the first embodiment.
Figure 7B:
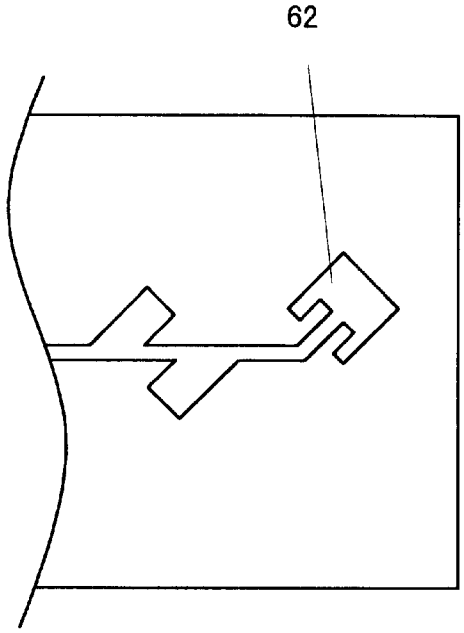

As shown in FIG. 7A, a matching termination element 61 for absorbing the residual power may be provided at the termination end 16. Alternatively, as shown in FIG. 7B, a microstrip antenna element 62 may be provided at the termination end 16 in order to radiate electrical power more efficiently.

The above-described configuration enables control of the excitation amplitude (radiation) of each radiation antenna element by means of changing the width of the element. Therefore, the antenna according to the present embodiment can have desired directivity-related characteristics; i.e., gain and side lobe level, which are determined in accordance with the intended use (specifications). Further, each of the radiation antenna elements 14*a* to 14*j* radiates or receives electromagnetic waves polarized in a direction inclined 45 degrees with respect to the feeder stripline 13 (in the direction of arrow E in FIG. 2A). Therefore, use of such a straight feeder stripline 13 enables realization of an array antenna having a plane of polarization inclined 45 degrees with respect to the feeder line.

Figure 8:
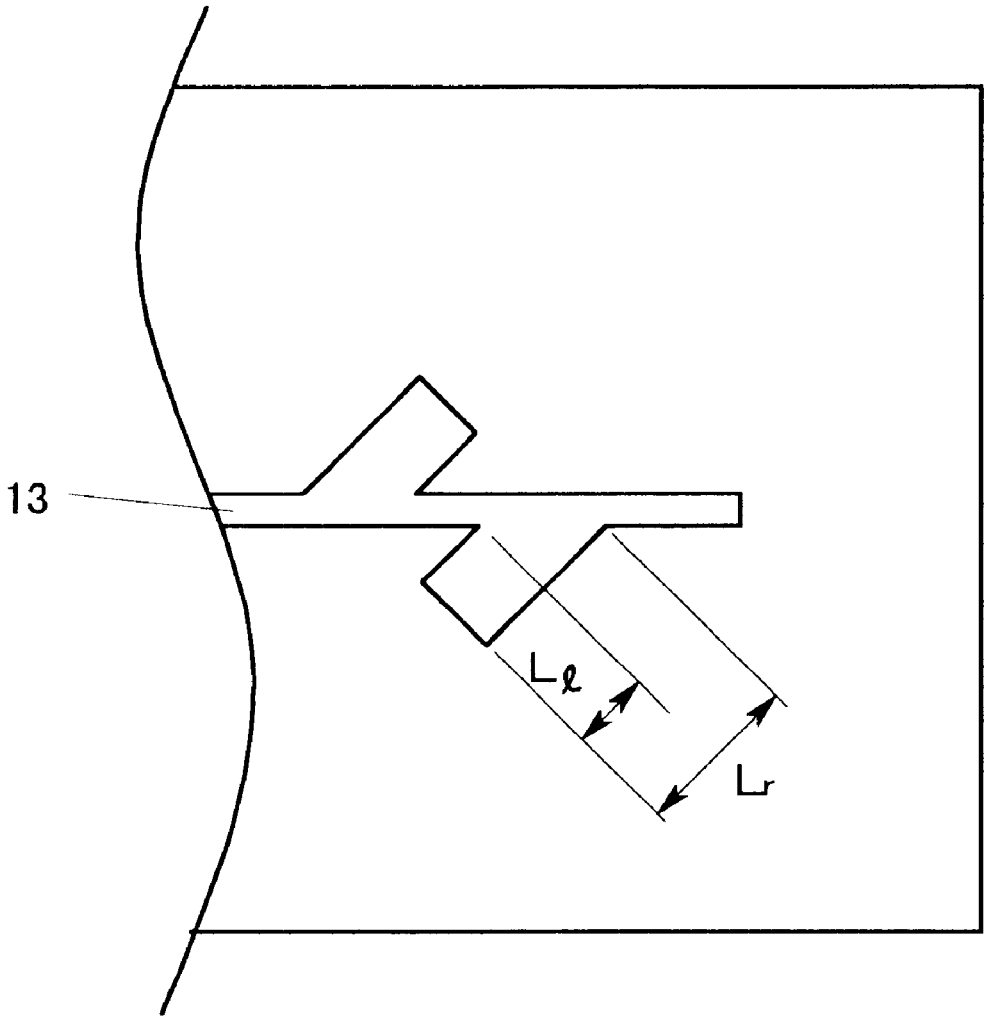
FIG. 8 is a plan view showing a specific dimensional relationship which raises a problem in the microstrip array antenna according to the first embodiment.

When the width of the radiation antenna elements 14*a* to 14*j* increases to such a degree that the difference between the length Ll of the front side and the length Lr of the rear side with respect to the direction of propagation of waves along the feeder stripline 13 becomes excessively large as shown in FIG. 8, impedance mismatch may occur, and unnecessary higher-order modes may be generated.

As shown in FIG. 5, the amount of electrical power reflected to the input terminal increases with the width of the radiation antenna elements. In other words, an array antenna in which a large number of radiation antenna elements 14 have a relatively large width involves a problem of a deteriorated overall radiation efficiency, because the radiation antenna elements do not operate effectively, due to increased reflection.

Further, generation of higher-order modes may cause deterioration of characteristics, such as an increased level of cross-polarized waves, lowered gain, and an irregular directivity pattern.

Figure 9:
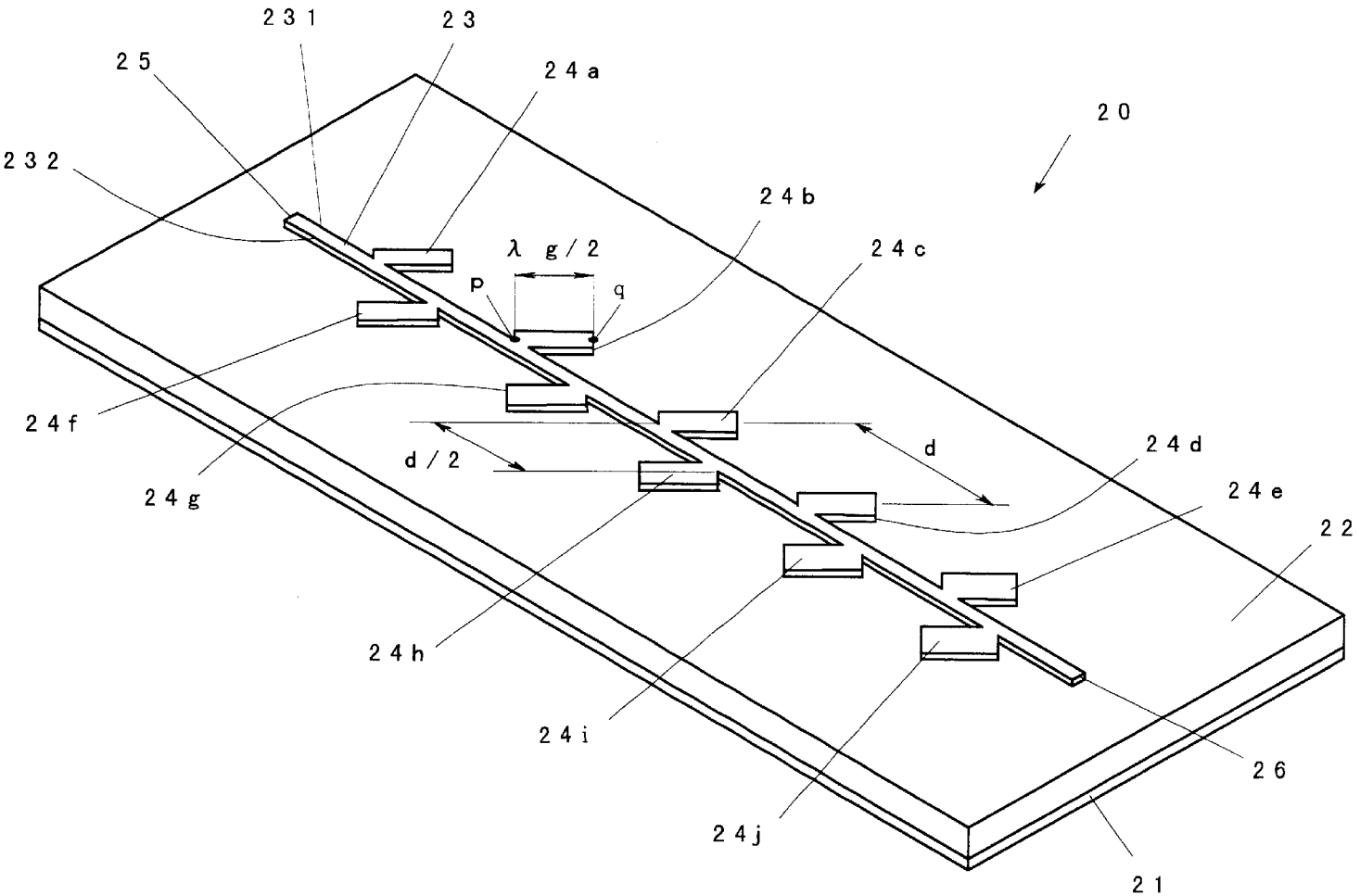
FIG. 9 is a perspective view showing the structure of a microstrip array antenna according to a second embodiment of the present invention.
Figure 10A:
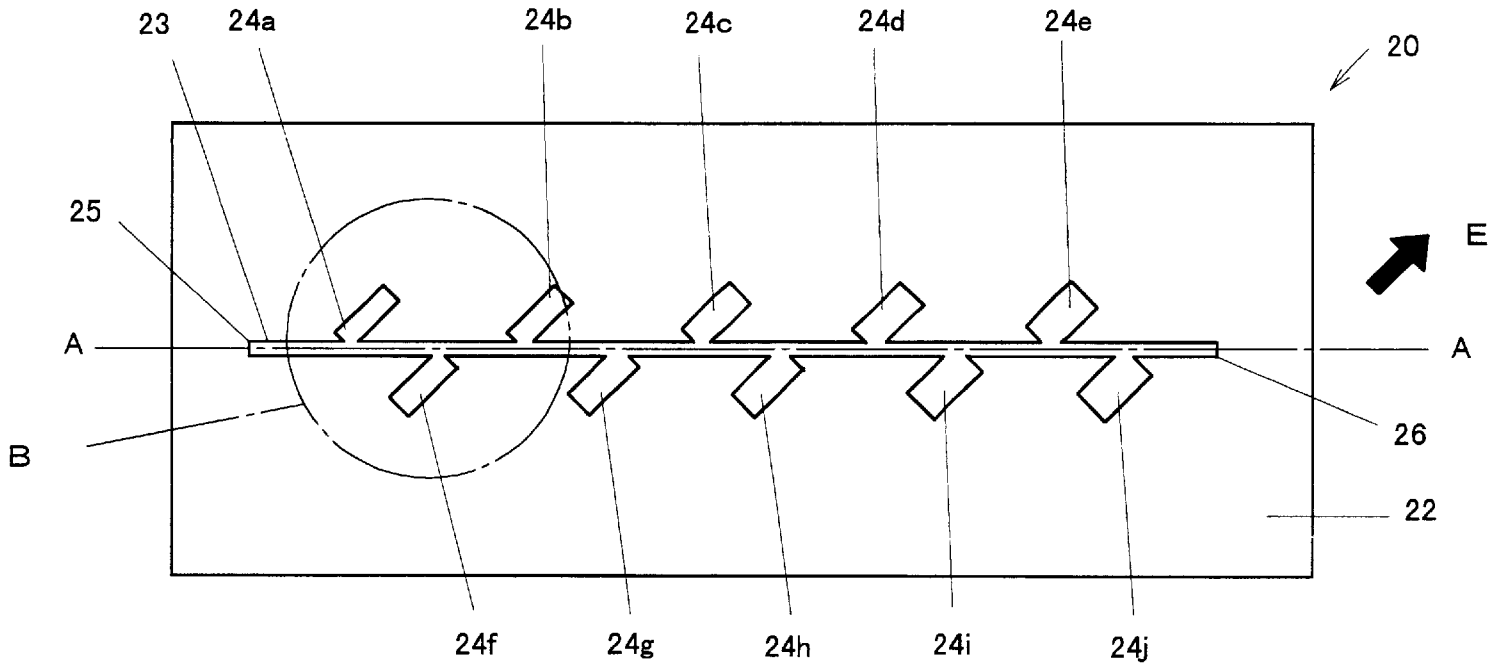
FIGS. 10A and 10B are plan and sectional views, respectively, of the microstrip array antenna according to the second embodiment.
Figure 10B:
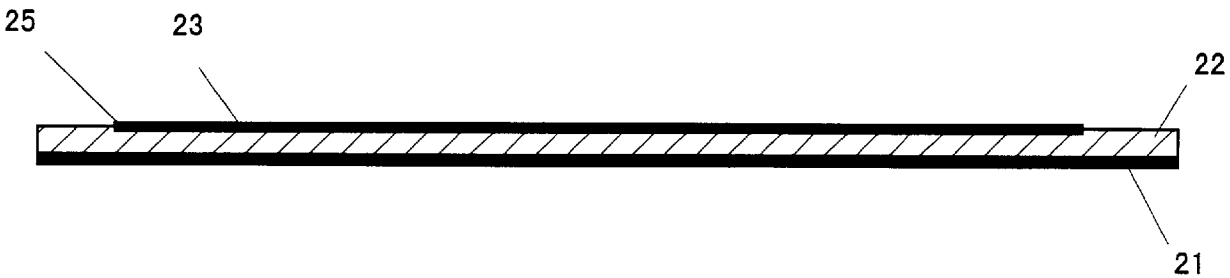
Figure 11:
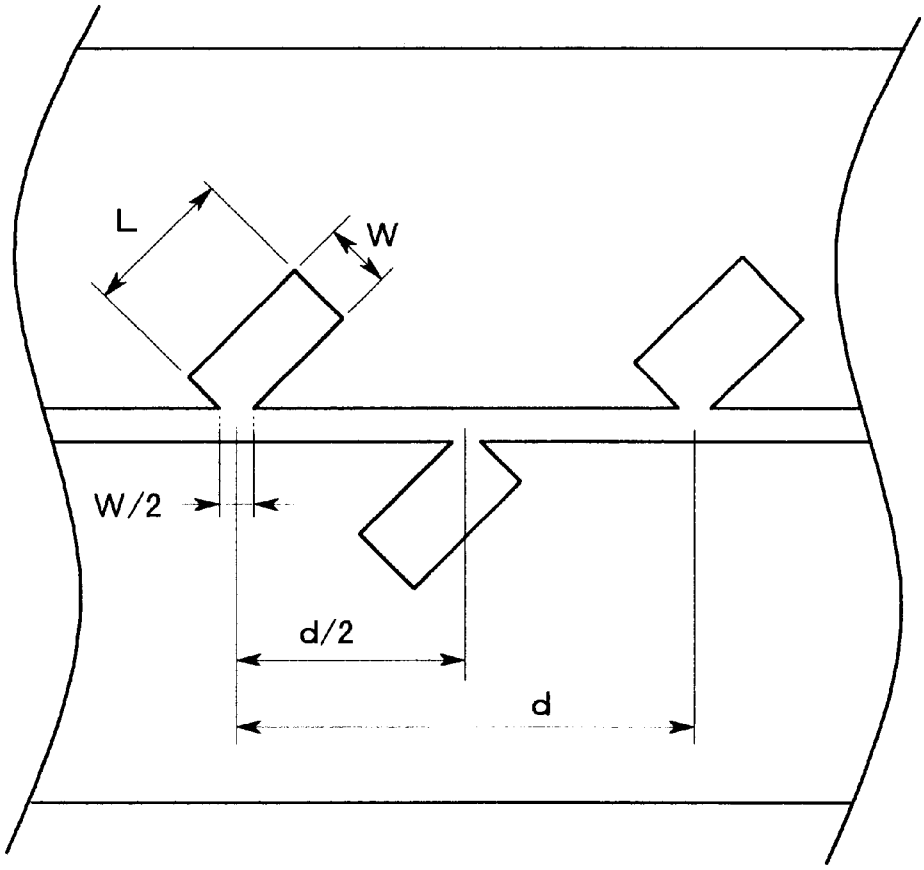
FIG. 11 is a plan view showing a specific dimensional relationship of the microstrip array antenna according to the second embodiment.

The structure according to a second embodiment, which will now be described, is effective for solving such problems. FIG. 9 shows a microstrip array antenna 20 according to the second embodiment of the present invention; FIG. 10A is a plan view of the microstrip array antenna 20; FIG. 10B is a sectional view taken along line A—A of FIG. 10A; and FIG. 11 is an enlarged view of a portion B of FIG. 10A. A ground conductor layer 21 is formed on a reverse face of a dielectric substrate 22; and a straight feeder stripline 23 and ten radiation antenna elements 24*a* to 24*j* projecting from the stripline 23 are formed on a top face of the dielectric substrate 22.

On the dielectric substrate 22, a first set of radiation antenna elements 24*a* to 24*e* each having a rectangular shape project from a first side edge 231 of the feeder stripline 23 such that the radiation antenna elements 24*a* to 24*e* incline at an angle of about 45 degrees with respect to the feeder stripline 23. The distance d between adjacent radiation antenna elements corresponds to an guide wavelength $\lambda_g$ of the feeder stripline 23 at an operating frequency, and the length (distance from the connection portion p to the open end q) of each radiation antenna element is set to about half the guide wavelength $\lambda_g$. The sides at the open ends of the projected radiation antenna elements 24*a* to 24*e* in the first set are parallel to each other and each form an angle of about +45 degrees with respect to the feeder stripline 23. Similarly, a second set of radiation antenna elements 24*f* to 24*j* each having a rectangular shape project from a second side edge 232 of the feeder stripline 23 in parallel to the radiation antenna elements 24*a* to 24*e* in the first set. The sides at the open ends of the radiation antenna elements 24*f* to 24*j* in the second set are parallel to each other, each form an angle of about −135 degrees with respect to the feeder stripline 23, and are parallel to the sides at the open ends of the radiation antenna elements 24*a* to 24*e* in the first set. Each of the radiation antenna elements 24*f* to 24*j* in the second set is disposed to be separated by, for example, d/2 from a corresponding one of the radiation antenna elements 24*a* to 24*e* in the first set.

As shown in FIG. 11, each of the rectangular radiation antenna elements 24*a* to 24*j* is connected to the corresponding side edge of the feeder stripline 23 via a corner thereof. The width of the boundary between the radiation antenna element and the feeder stripline 23 is equal to or less than about half the length W of a shorter side of the rectangular radiation antenna element.

Figure 12:
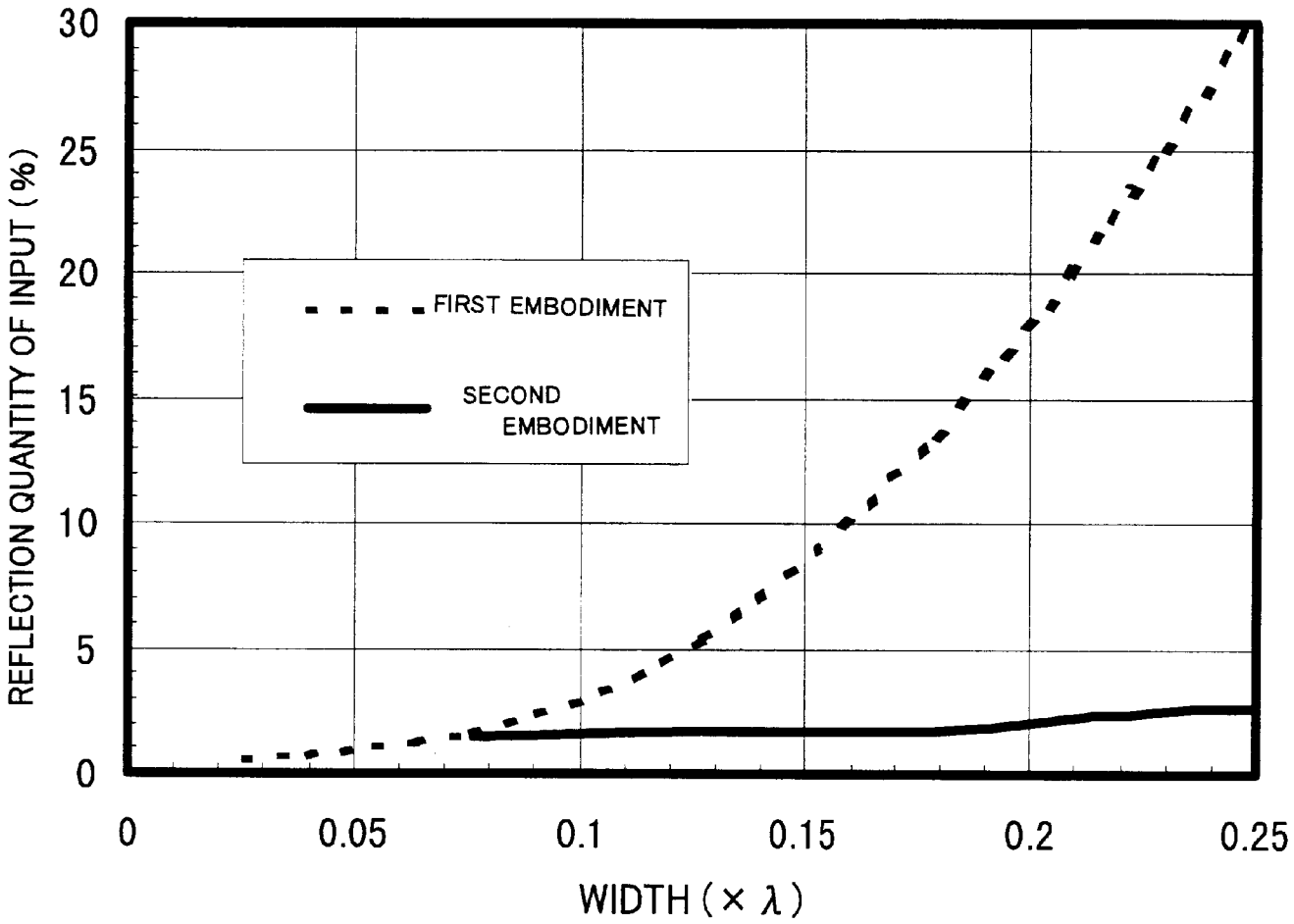
FIGS. 12 and 13 are graphs showing characteristics of a radiation antenna element of the microstrip array antenna according to the second embodiment.

FIG. 12 shows variation in reflection when the width of the radiation antenna element 24 according to the second embodiment is changed. FIG. 12 also shows the corresponding characteristic of the radiation antenna element 14 according to the first embodiment. In FIG. 12, the horizontal axis represents the width of the radiation antenna elements 14 and 24 as normalized with respect to a free-space wavelength λ at the operating frequency, and the vertical axis represents electrical power reflected to the input terminal as a percentage of input. As is apparent from FIG. 12, in the case of the radiation antenna element 24 according to the second embodiment, even when the width increases, the amount of electrical power reflected to the input terminal does not increase, and reflection characteristics deteriorate only slightly. In other words, even in an array antenna in which a large number of radiation antenna elements 24 have a relatively large width, each radiation antenna element operates effectively, so that the array antenna can radiate waves at extremely high efficiency.

Figure 13:
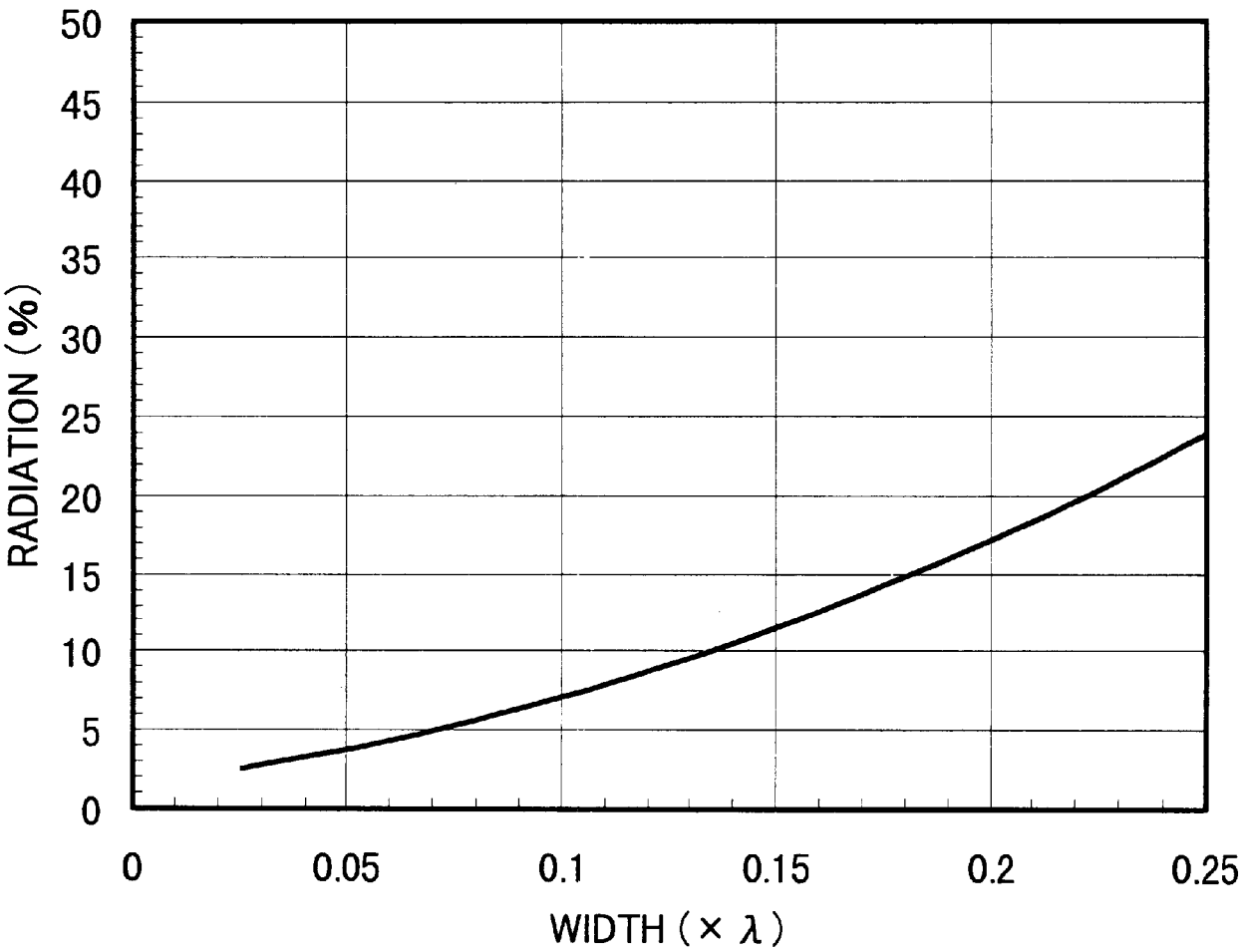

Electrical power input from an input terminal 25 is sequentially fed to the radiation antenna elements 24*a*, 24*f*, 24*b*, etc. and is radiated therefrom, and the remaining electrical power propagates in a traveling direction (rightward in FIGS. 10A and 10B) while attenuating gradually and finally reaches a termination end 26. As in the case of the above-described first embodiment, in the array antenna according to the present embodiment, through change in the width of the radiation antenna elements 24*a* to 24*j*, electrical power distributed to each element (i.e., excitation amplitude or radiation power of each element) can be controlled in order to obtain a desired directivity. The radiation of each radiation antenna element increases with the width of the element, due to an increasing degree of coupling (see FIG. 13). Preferably, the width W of the radiation antenna elements (shown in FIG. 11) differs from the length L thereof, such that an inequality W<L is satisfied. However, the width W and t he length L of the radiation antenna elements may be determined to satisfy an inequality W>L insofar as an increased width does not cause an adverse effect such as physical interference between adjacent elements.

As in the case of the first embodiment, a matching termination element 61 shown in FIG. 7A and adapted to absorb the residual power may be provided at the termination end 26 shown in FIG. 10A. Alternatively, a microstrip antenna element 62 shown in FIG. 7B may be provided at the termination end 26 in order to radiate electrical power more efficiently.

The above-described configuration enables control of the excitation amplitude (radiation) of each radiation antenna element by means of changing the width of the element. Therefore, the antenna according to the present embodiment can have desired directivity-related characteristics; i.e., gain and side lobe level, which are determined in accordance with the intended use (specifications).

Further, each of the radiation antenna elements 24*a* to 24*j* radiates or receives electromagnetic waves polarized in a direction inclined 45 degrees with respect to the feeder stripline 23 (in the direction of arrow E in FIG. 10A). Therefore, it becomes possible to realize an array antenna which has excellent characteristics in terms of cross-polarized waves and which has a plane of polarization inclined 45 degrees with respect to the feeder stripline 23.

Figure 14:
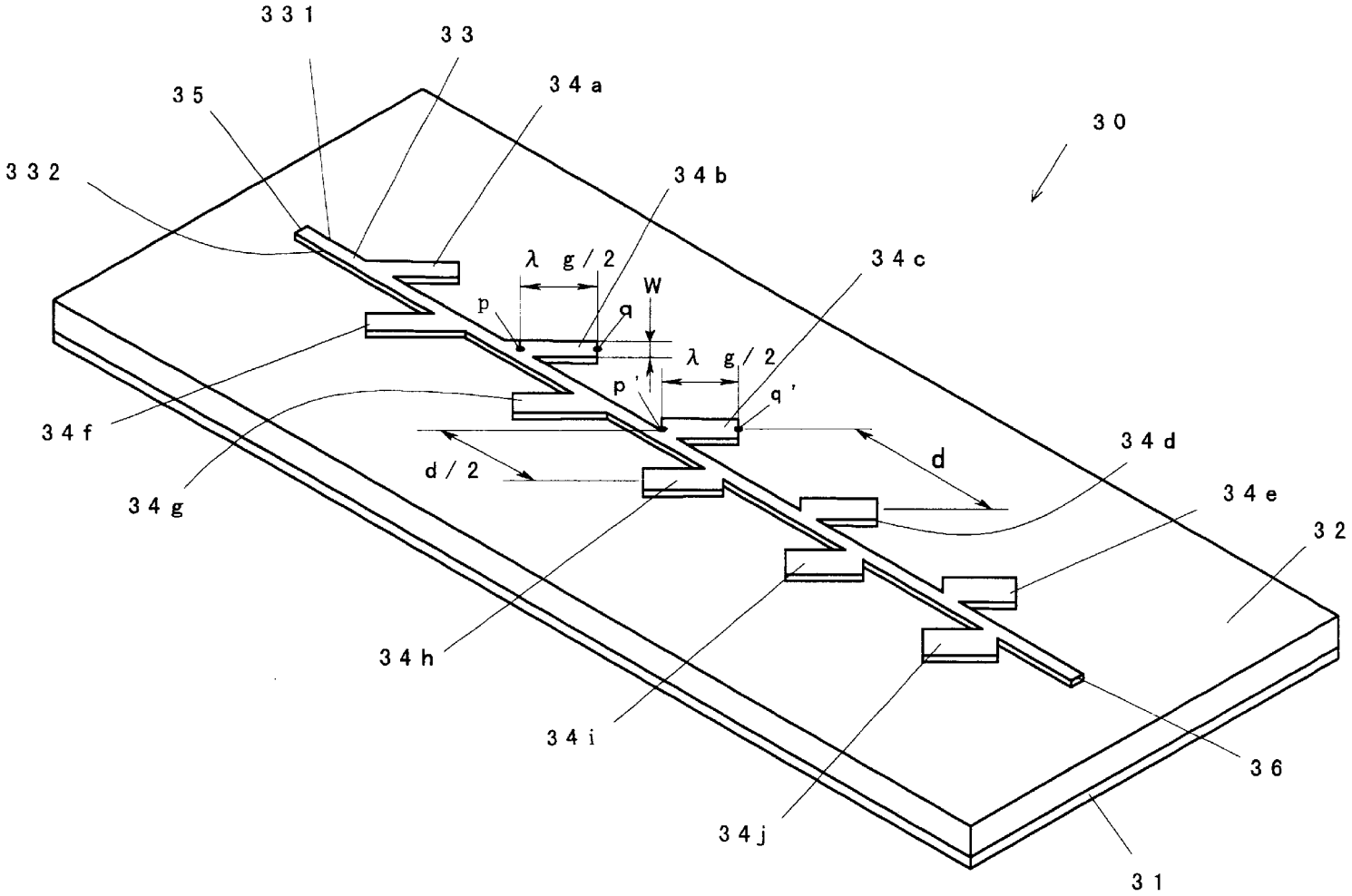
FIG. 14 is a perspective view showing the structure of a microstrip array antenna according to a third embodiment of the present invention.
Figures 15A, 15B:
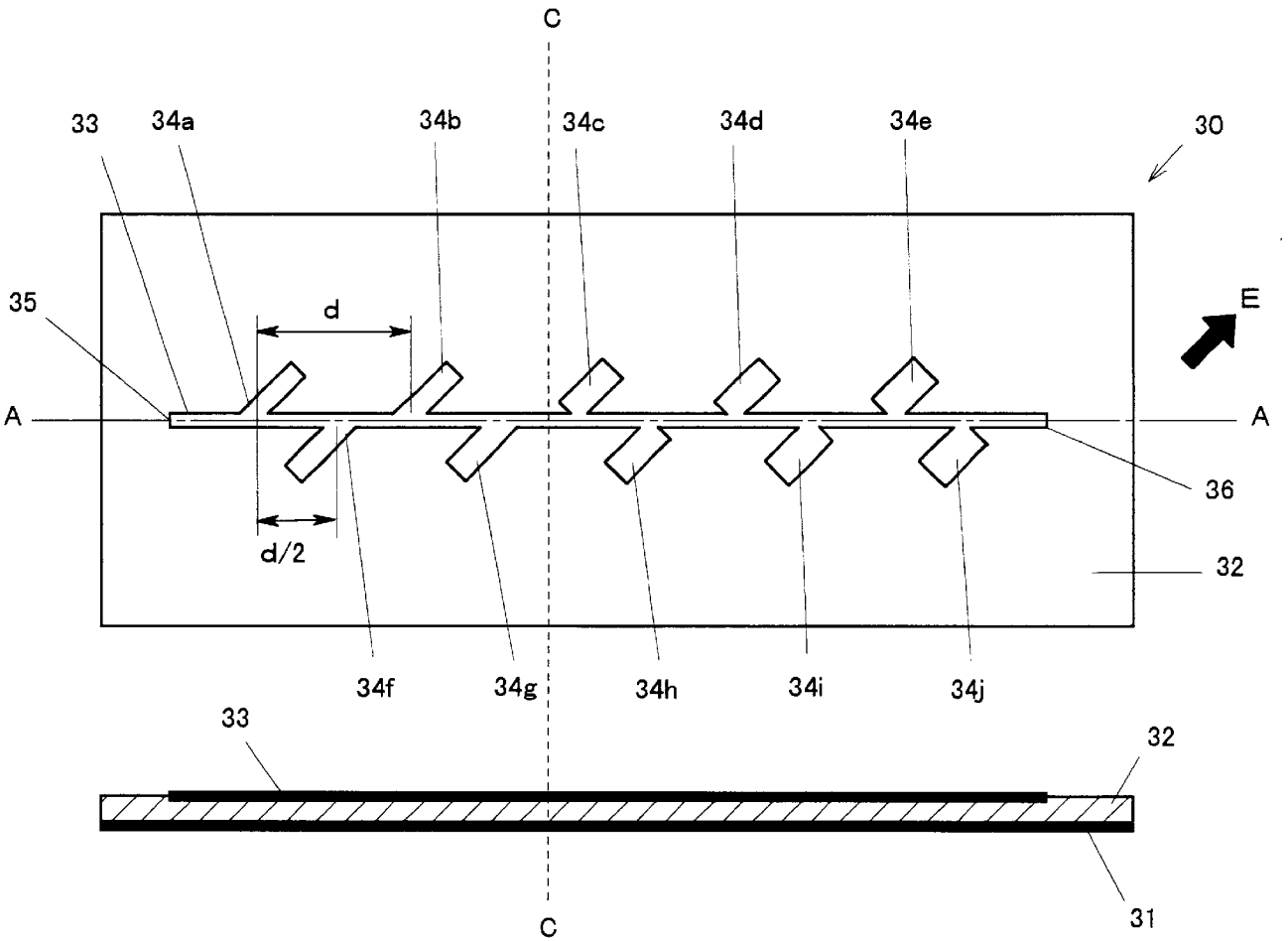
FIGS. 15A and 15B are plan and sectional views, respectively, of the microstrip array antenna according to the third embodiment.

FIG. 14 shows a microstrip array antenna 30 according to a third embodiment of the present invention; FIG. 15A is a plan view of the microstrip array antenna 30; and FIG. 15B is a sectional view taken along line A—A of FIG. 15A. A straight feeder stripline 33 and ten radiation antenna elements 34*a* to 34*j* projecting from the stripline 33 are formed on a top face of a dielectric substrate 32. Among the radiation antenna elements 34*a* to 34*j*, the radiation antenna elements 34*a*, 34*b*, 34*f*, and 34*g* have a strip-like shape as in the first embodiment, and the radiation antenna elements 34*c*, 34*d*, 34*e*, 34*h*, 34*i*, and 34*j* have a rectangular shape as in the second embodiment. On the dielectric substrate 32, radiation antenna elements 34*a* to 34*e* in a first set project from a first side edge 331 of the feeder stripline 33 such that the radiation antenna elements 34*a* to 34*e* incline at an angle of about 45 degrees with respect to the feeder stripline 33. The distance d between adjacent radiation antenna elements corresponds to an guide wavelength $\lambda_g$ of the feeder stripline 33 at an operating frequency, and the length (distance from the center p of the connected portion to the open end q or from the connection point p' to the open end q') of each radiation antenna element is set to about half the guide wavelength $\lambda_g$. The sides at the open ends of the projected radiation antenna elements 34*a* to 34*e* in the first set are parallel to each other and each form an angle of about +45 degrees with respect to the feeder stripline 33. Similarly, a second set of radiation antenna elements 34*f* to 34*j* project from a second side edge 332 of the feeder stripline 33 in parallel to the radiation antenna elements 34*a* to 34*e* in the first set. The sides at the open ends of the radiation antenna elements 34*f* to 34*j* in the second set are parallel to each other, each form an angle of about −135 degrees with respect to the feeder stripline 33, and are parallel to the sides at the open ends of the radiation antenna elements 34*a* to 34*e* in the first set. Each of the radiation antenna elements 34*f* to 34*j* in the second set is disposed to be separated by, for example, $\lambda_g/2$ from a corresponding one of the radiation antenna elements 34*a* to 34*e* in the first set. The width of each radiation antenna element is determined such that the excitation amplitude (radiation) of the element reaches a value required for obtaining a desired directivity. At this time, with reference to the refection characteristics shown in FIG. 12, an antenna-element shape which provides better reflection characteristics is selected. That is, when the width is less than about 0.075λ, a radiation antenna element according to the first embodiment is used, and when the width is equal to or greater than about 0.075λ, a radiation antenna element according to the second embodiment is used. In the present embodiment shown in FIGS. 15A and 15B, radiation antenna elements according to the first embodiment are used on the left side of a border line represented by line C—C, and radiation antenna elements according to the second embodiment are used on the right side of the border line.

The above-described structure enables provision of an radiation antenna element having excellent reflection characteristics even when the degree of coupling between the feeder stripline and the radiation antenna element is changed in a wide range in order to realize a desired excitation amplitude (radiation). Thus, highly efficient array antennas having different directivities can be realized.

Figure 16:
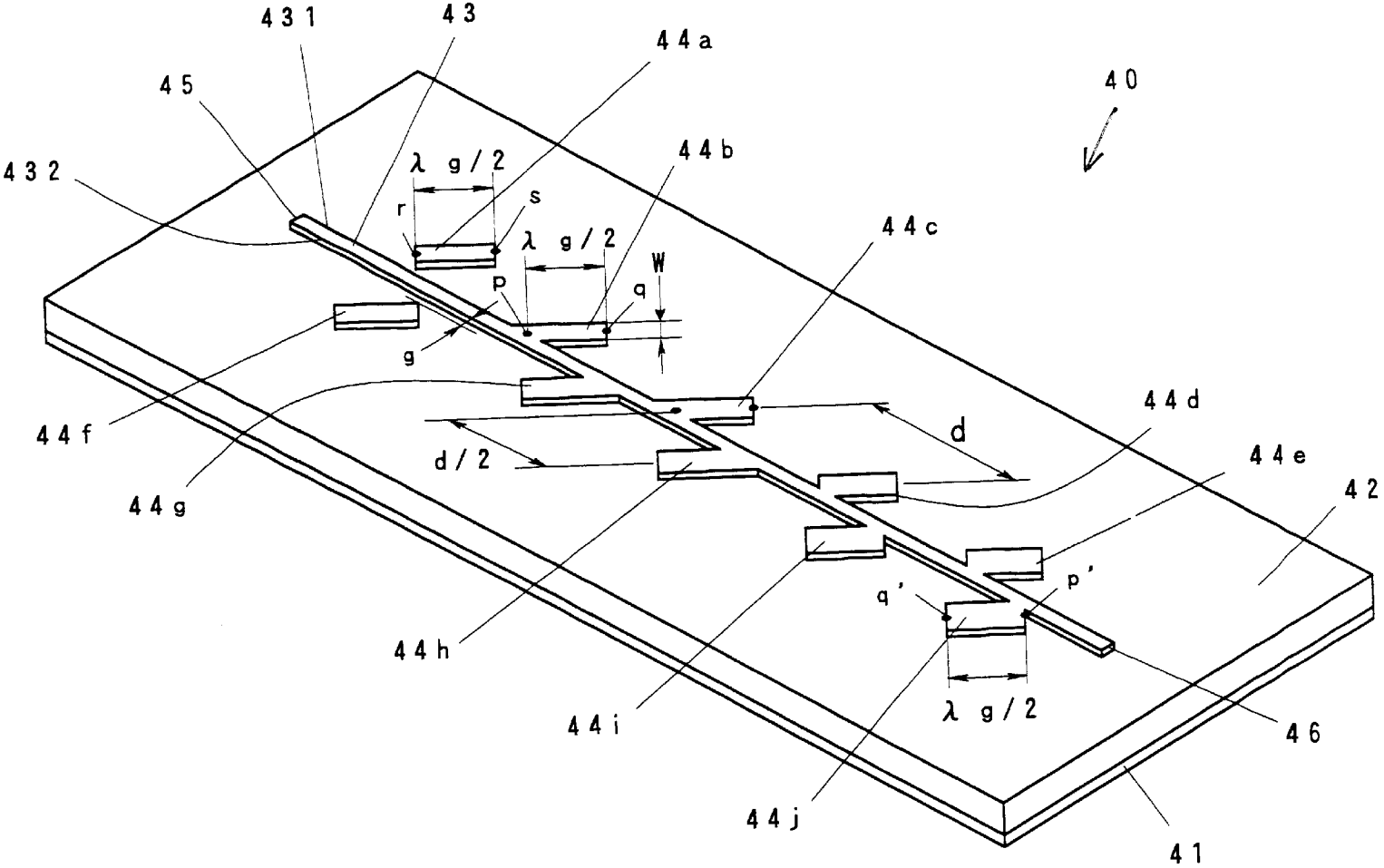
FIG. 16 is a perspective view showing the structure of a microstrip array antenna according to a fourth embodiment of the present invention.
Figures 17A, 17B:
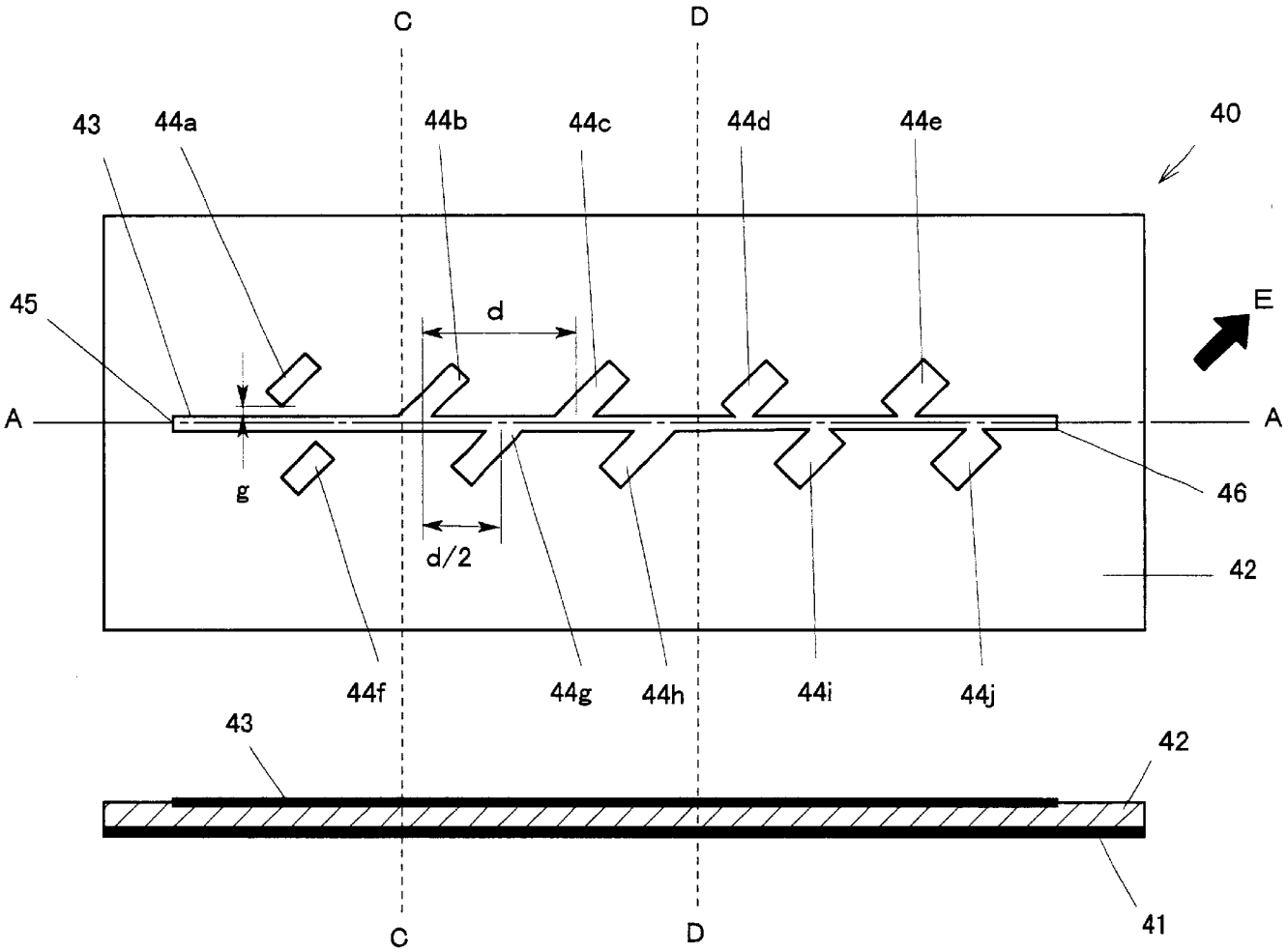
FIGS. 17A and 17B are plan and sectional views, respectively, of the microstrip array antenna according to the fourth embodiment.
Figure 18:
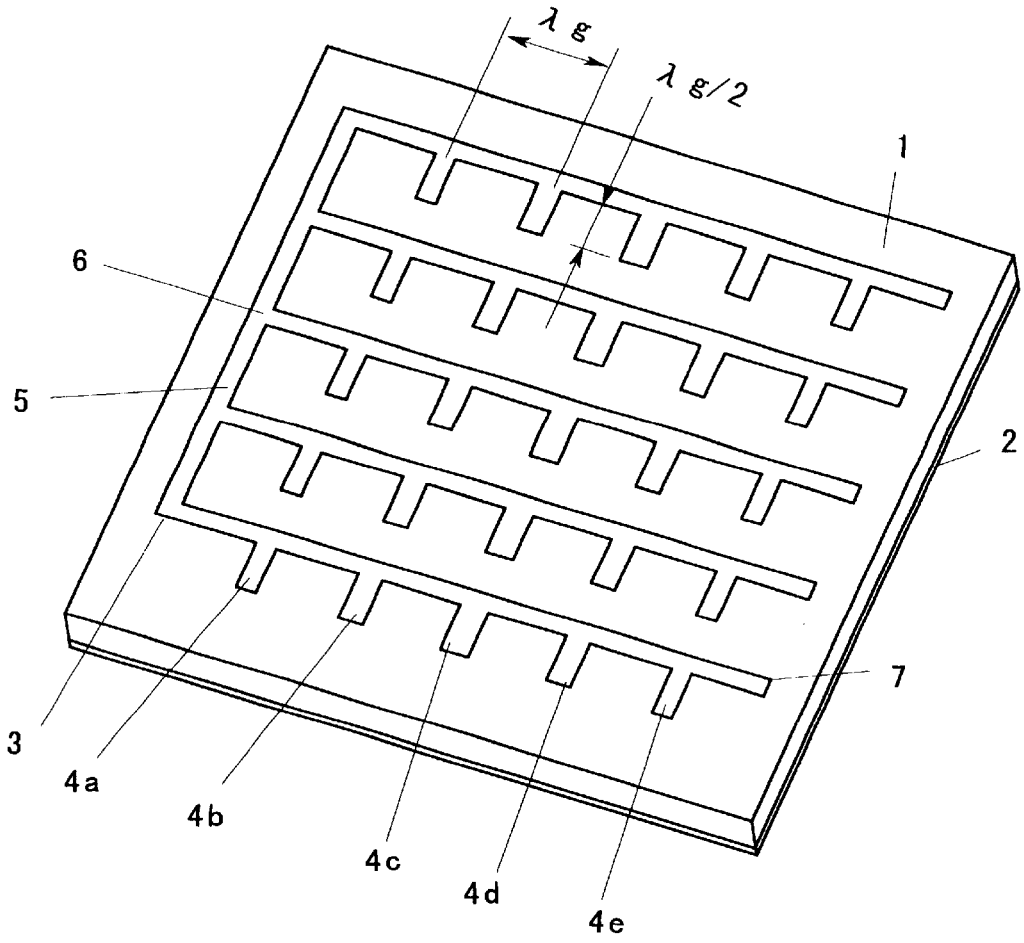
FIG. 18 PRIOR ART
FIG. 18 is a perspective view of a conventional microstrip array antenna.
Figure 19:
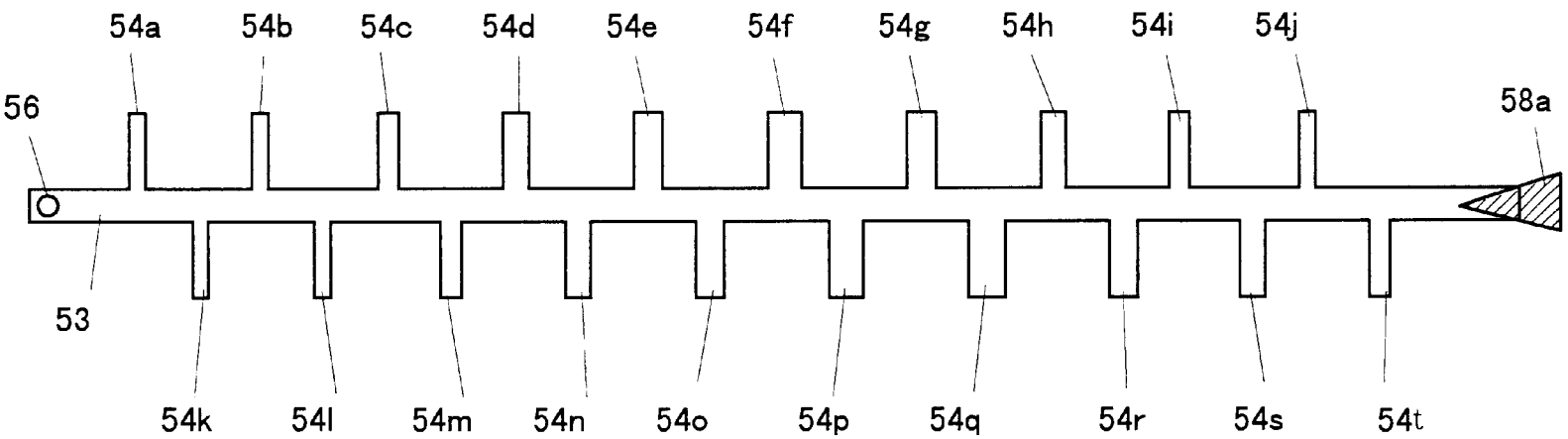
FIG. 19 PRIOR ART
FIG. 19 is a plan view of another conventional microstrip array antenna.
Figure 20:
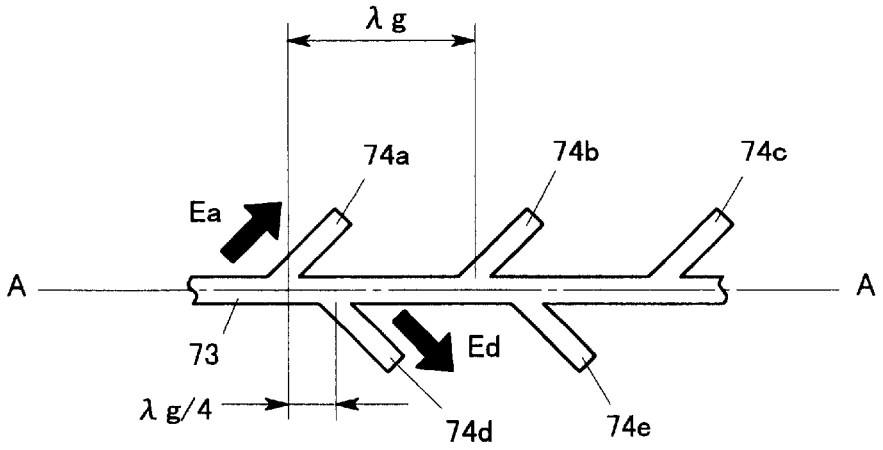
FIG. 20 PRIOR ART
FIG. 20 is a plan view of another conventional microstrip array antenna.
Figure 21A:
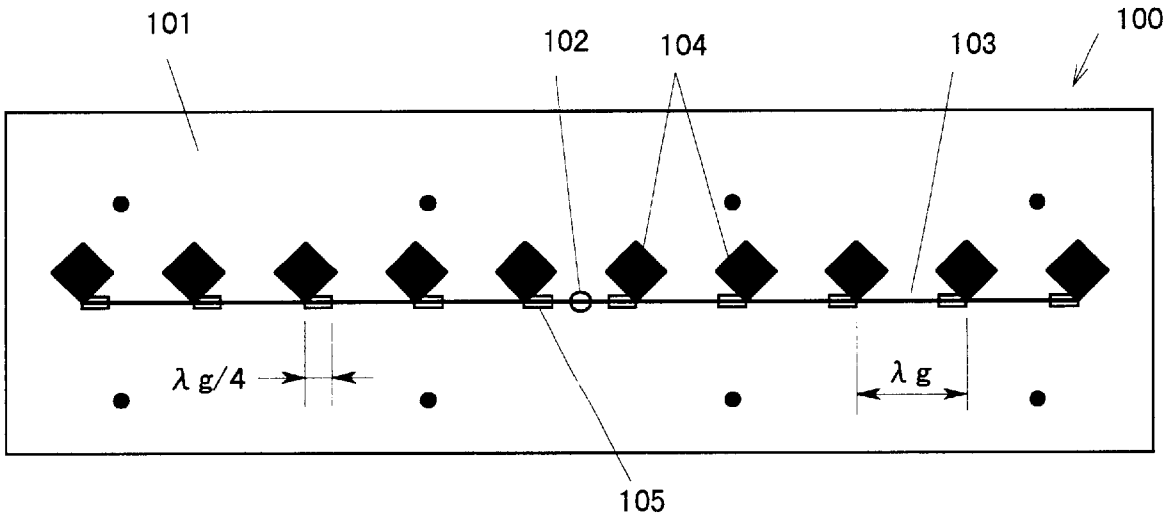
FIG. 21A PRIOR ART
FIGS. 21A and 21B are plan views of other conventional microstrip array antennas.
Figure 21B:
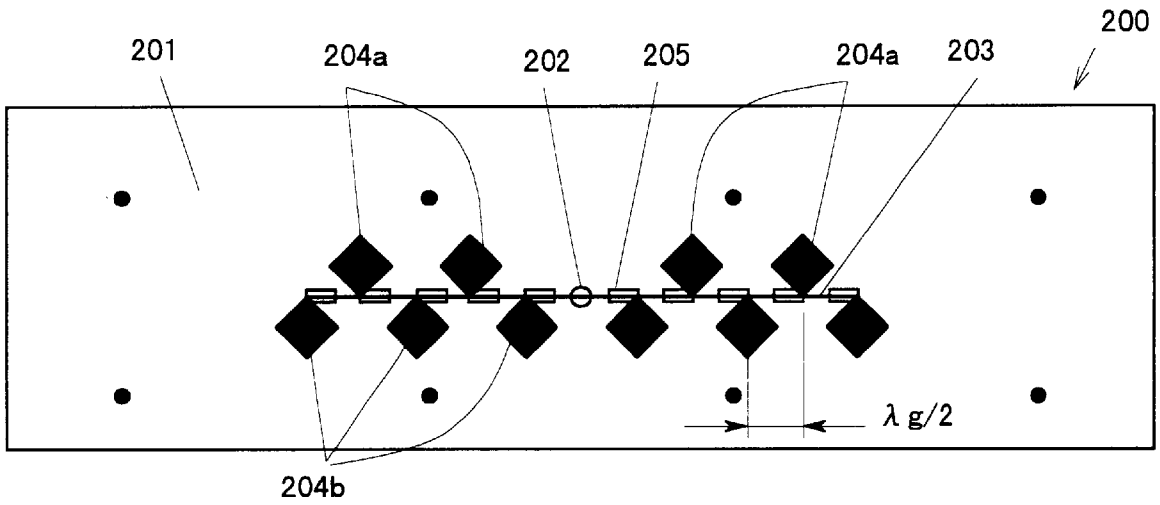
FIG. 21B PRIOR ART
Figure 22A:
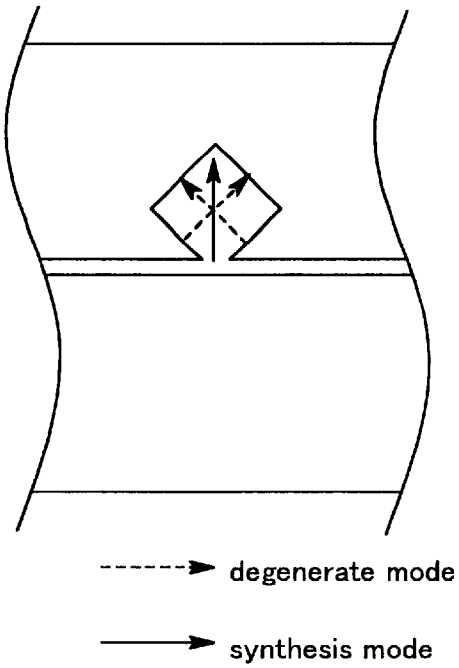
FIGS. 22A and 22B are explanatory views showing the principle of operation of the conventional microstrip array antennas of FIGS. 21A and 21B.
Figure 22B:
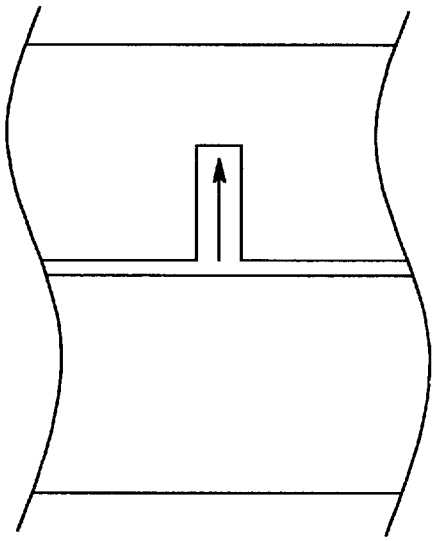

FIG. 16 shows a microstrip array antenna 40 according to a fourth embodiment of the present invention; FIG. 17A is a plan view of the microstrip array antenna 40; and FIG. 17B is a sectional view taken along line A—A of FIG. 17A. On a dielectric substrate 42, radiation antenna elements 44*a* to 44*e* in a first set are disposed on the side of a first side edge 431 of the feeder stripline 43 such that the radiation antenna elements 44*a* to 44*e* incline at an angle of about 45 degrees with respect to the feeder stripline 43. Each of the radiation antenna elements 44*a* to 44*e* has a strip-like shape or a rectangular shape and is connected to the feeder stripline 43 or is separated from the feeder stripline 43. The distance d between adjacent radiation antenna elements corresponds to an guide wavelength $\lambda_g$ of the feeder stripline 43 at an operating frequency, and the length (distance from the center p of the connected portion to the open end q, from the connection point p'. to the open end q', or between opposite open ends r and s) of each radiation antenna element is set to about half the guide wavelength $\lambda_g$. The sides at the open ends of the projected radiation antenna elements 44*a* to 44*e* in the first set are parallel to each other and each form an angle of about +45 degrees with respect to the feeder stripline 43. Similarly, a second set of radiation antenna elements 44*f* to 44*j* are disposed on the side of a second side edge 432 of the feeder stripline 43 in parallel to the radiation antenna elements 44*a* to 44*e* in the first set. Each of the radiation antenna elements 44*f* to 44*j* has a strip-like shape or a rectangular shape and is connected to the feeder stripline 43 or is separated from the feeder stripline 43. The sides at the open ends of the radiation antenna elements 44*f* to 44*j* in the second set are parallel to each other, each form an angle of about −135 degrees with respect to the feeder stripline 43, and are parallel to the sides at the open ends of the radiation antenna elements 44*a* to 44*e* in the first set. Each of the radiation antenna elements 44*f* to 44*j* in the second set is disposed to be separated by, for example, $\lambda_g/2$ from a corresponding one of the radiation antenna elements 44*a* to 44*e* in the first set. The shape of each radiation antenna element is determined such that the excitation amplitude (radiation) of the element reaches a value required for obtaining a desired directivity. When an excitation amplitude (radiation) of a certain radiation antenna element determined to obtain a desired directivity is equal to or greater than 2%, an antenna-element shape which provides better reflection characteristics is selected with reference to the reflection characteristics shown in FIG. 12. That is, when the width is less than about 0.075λ, a radiation antenna element according to the first embodiment is used, and when the width is equal to or greater than about 0.075λ, a radiation antenna element according to the second embodiment is used. When the determined excitation amplitude (radiation) of the element is less than 2%, the rectangular radiation antenna element according to the second embodiment is disposed such that a predetermined gap g is formed between the element and the feeder stripline. The excitation amplitude (radiation) decreases as the gap g increases. When the gap g is constant, the radiation increases as the width of the radiation antenna element increases. The gap and width can be freely determined in accordance with, for example, a limit in dimensional accuracy in fabrication of the antenna, insofar as the requirements on the excitation amplitude (radiation) are satisfied. In the present embodiment shown in FIGS. 17A and 17B, non-contact radiation antenna elements are used on the left side of a first border line represented by line C—C; radiation antenna elements according to the first embodiment are used between the first border line and a second border line represented by line D—D; and radiation antenna elements according to the second embodiment are used on the right side of the second border line.

The above-described structure makes it possible to obtain a very small excitation amplitude (radiation). This enables realization of an array antenna which has a relatively large number of elements and in which the excitation amplitude of each element is small and an array antenna in which excitation amplitudes at opposite ends of the array are reduced in order to shrink side lobes.

Figure 23:
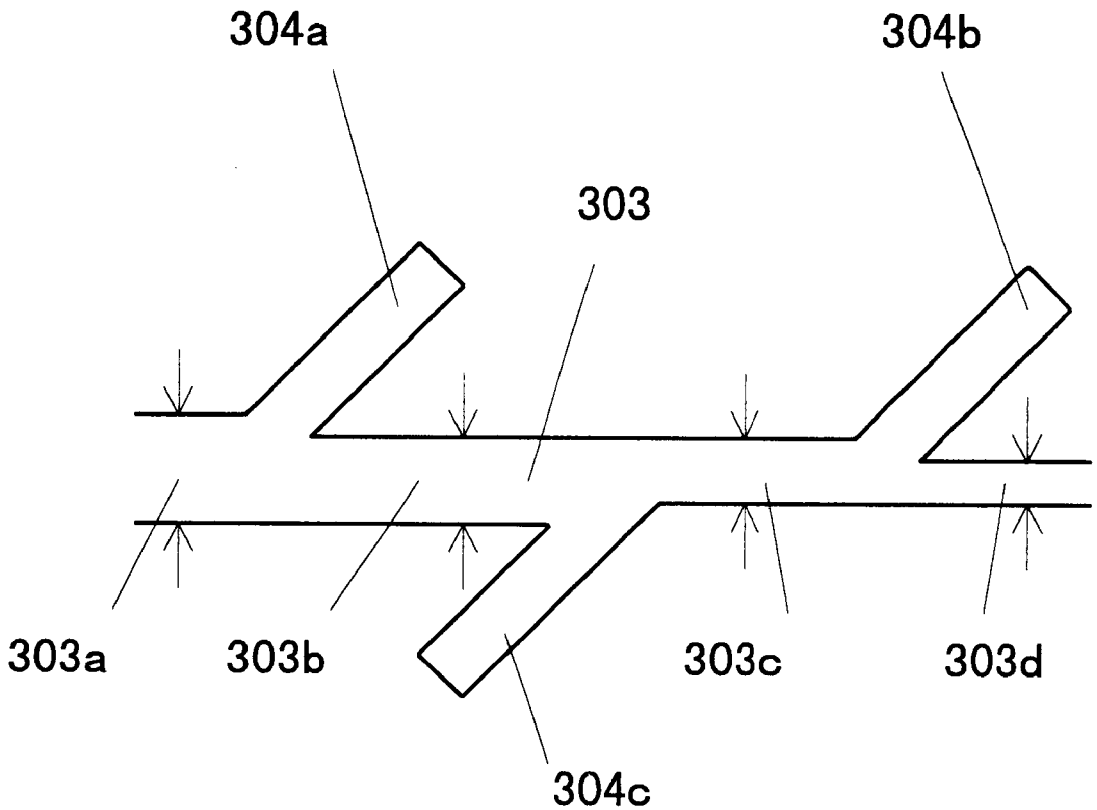
FIG. 23 is a plan view of a microstrip array antenna according to a modified embodiment of the present invention in which the width of the feeder stripline is changed stepwise.

In each of the above described embodiments, the feeder stripline has a constant width throughout its length. However, as shown in FIG. 23, the width of the feeder stripline may be changed stepwise (303*a* to 303*d*). This configuration can further widen a range of control of radiation.

Figure 24:
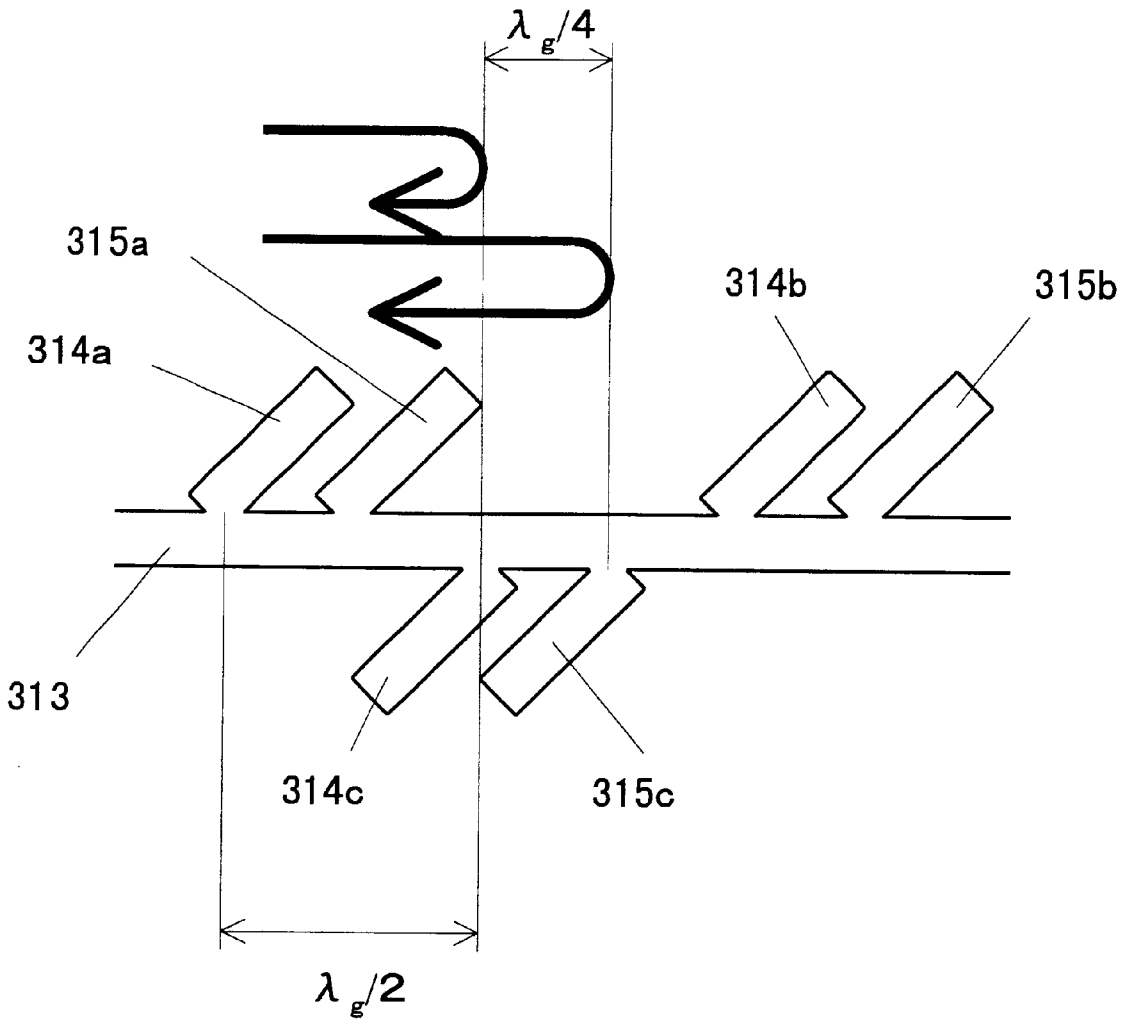
FIG. 24 is a plan view of a microstrip array antenna according to another modified embodiment of the present invention in which each radiation antenna element includes paired elements.

In each of the above-described embodiments, the radiation antenna elements are disposed on either side of the feeder stripline at intervals of $\lambda_g/2$. However, as shown in FIG. 24, in addition to radiation antenna elements 314*a* to 314*c*, radiation antenna elements 315*a* to 315*c* may be provided at positions spaced $\lambda_g/4$ away from respective radiation antenna elements 314*a* to 314*c*. This structure decreases the refection amount of each pair including two radiation antenna elements (paired elements) disposed with a distance of $\lambda_g/4$ therebetween, because the paired radiation antenna elements (e.g., 314*b* and 315*b*) reflect waves in opposite phases, so that the reflected waves cancel each other out. Since the reflection of the array antenna can be decreased further, the array antenna can have a higher radiation efficiency or reception sensitivity.

Figure 25:
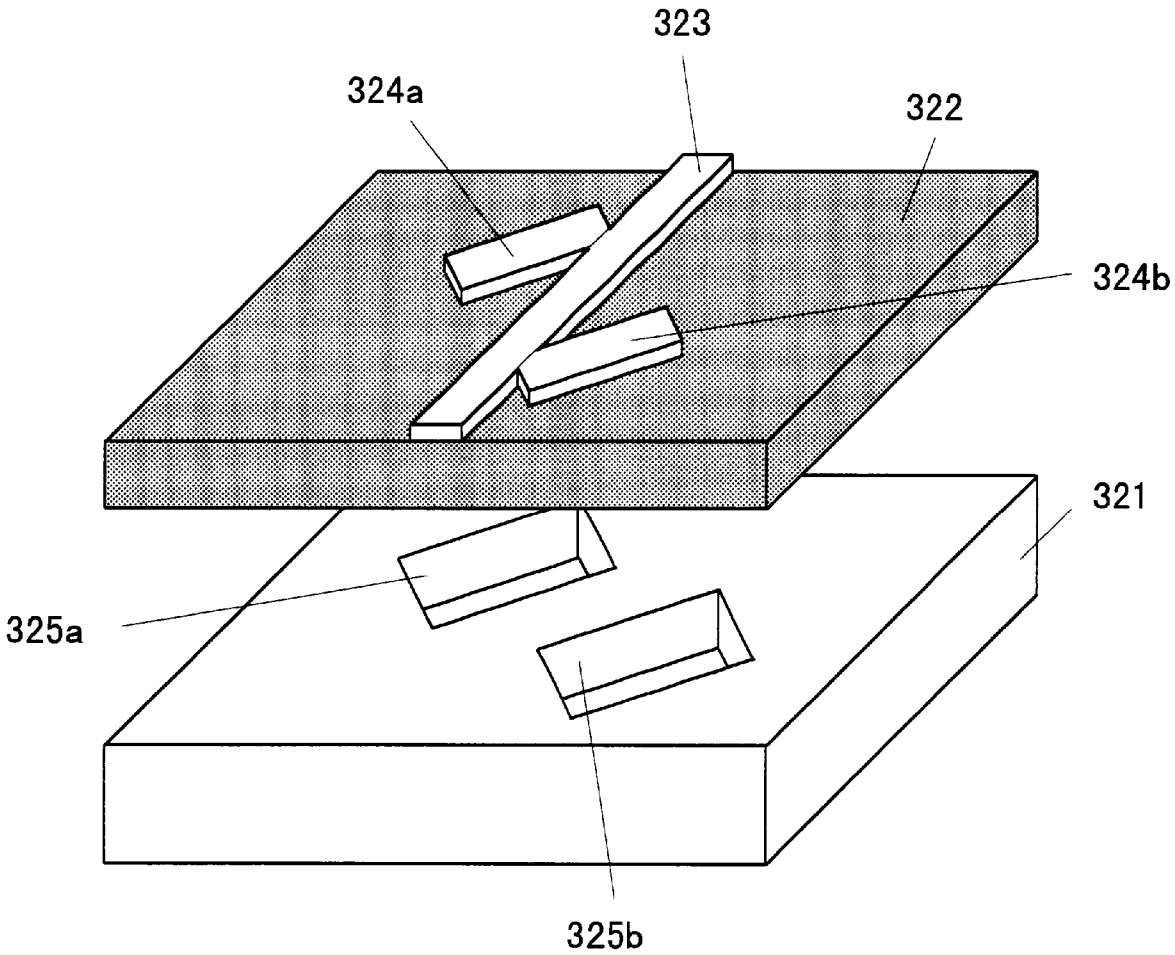
FIG. 25 is a perspective view of a microstrip array antenna according to another modified embodiment of the present invention in which cavities are provided.

In each of the above described embodiments, a ground layer is provided on the reverse face of the dielectric substrate opposite the face carrying radiation antenna elements. However, as shown in FIG. 25, instead of the ground layer, a metal casing 321 may be provided. The casing 321 has cavities 325*a* and 325*b* each having an area and a depth substantially equal to those of the radiation antenna elements 324*a* and 324*b*. This structure enables realization of an array antenna having a further increased radiation efficiency or reception sensitivity.

Figure 26:
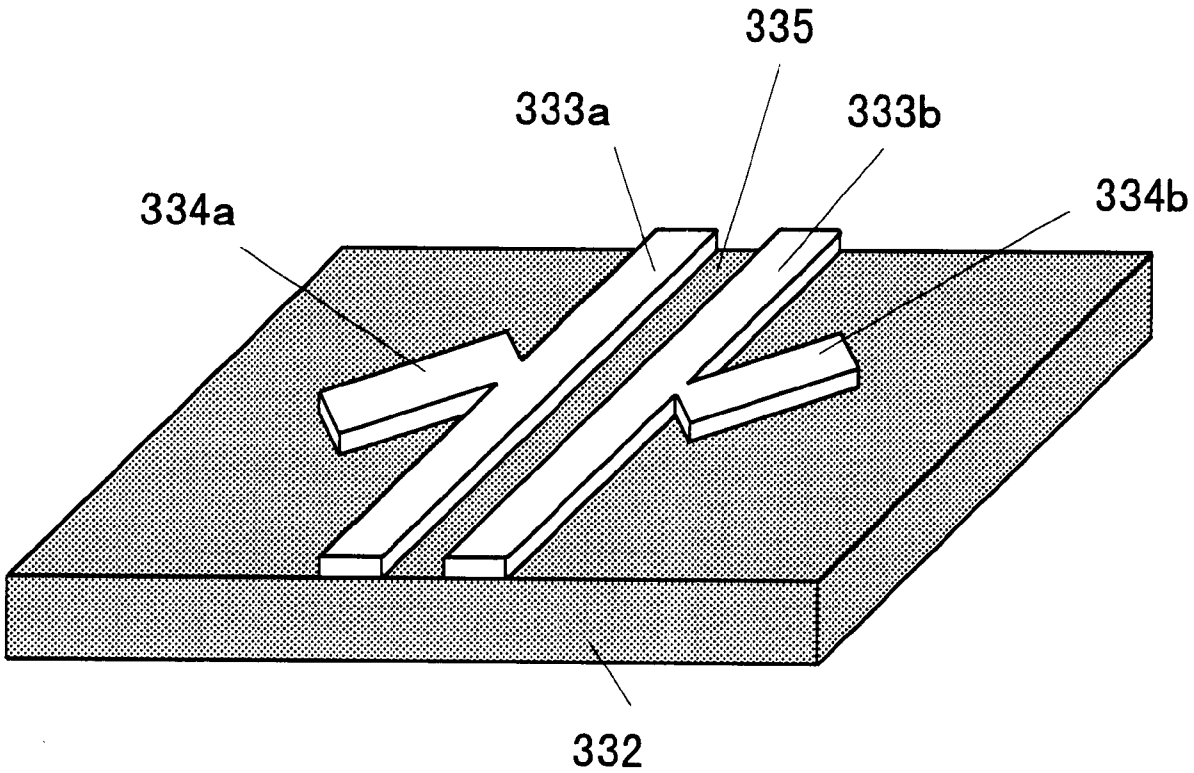
FIG. 26 is a perspective view of a microstrip array antenna according to another modified embodiment of the present invention in which the feeder line assumes the form of coplanar striplines.
Figure 27:
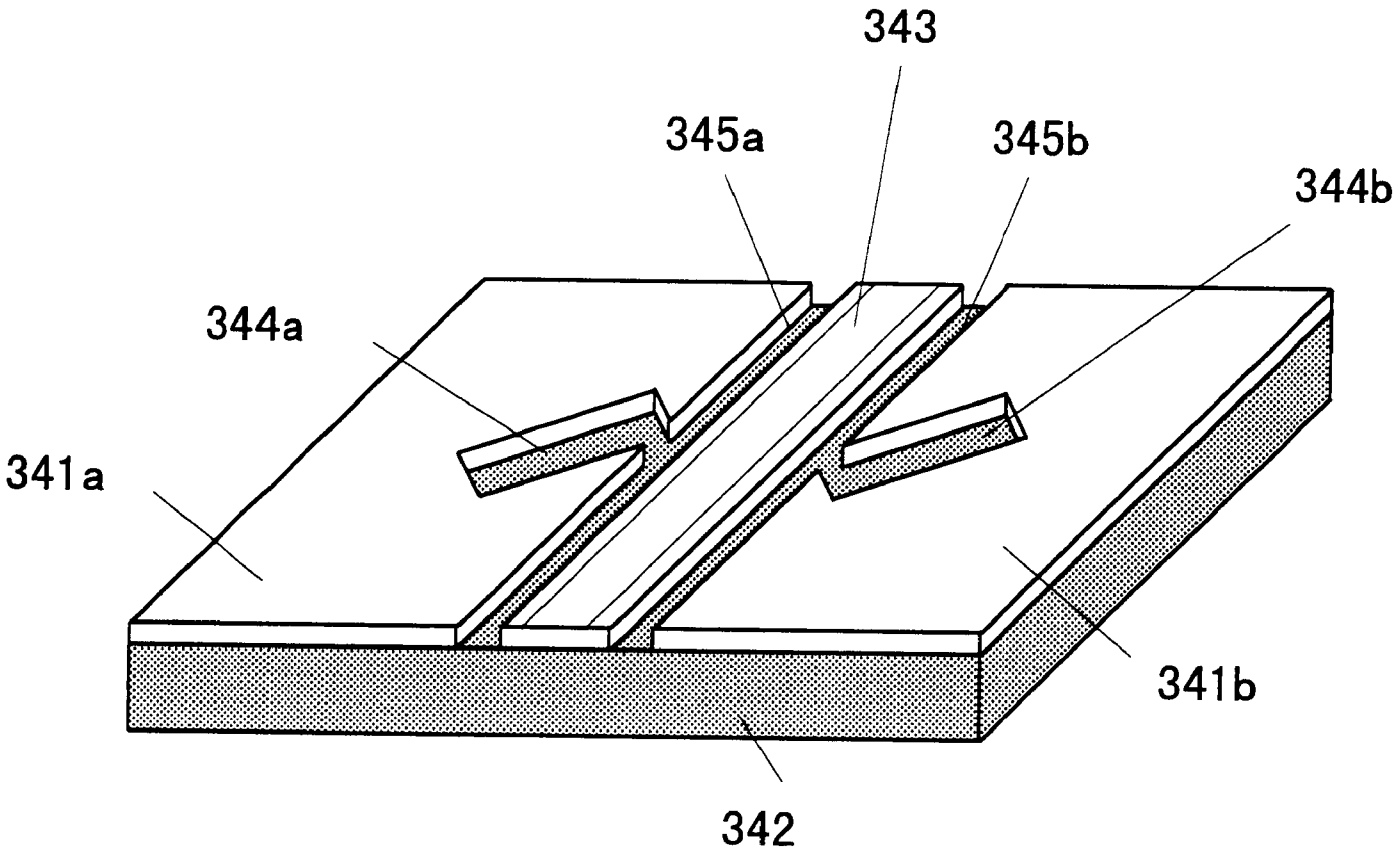
FIG. 27 is a perspective view of a microstrip array antenna according to another modified embodiment of the present invention in which the feeder line assumes the form of coplanar lines.

In each of the above described embodiments, a stripline is used as a feeder line; however, other types of feeder lines may be used. FIG. 26 shows an array antenna including two parallel striplines 333*a* and 333*b* which are disposed with a predetermined distance 335 therebetween in order to form coplanar striplines serving as a feeder line. FIG. 27 shows an array antenna including a stripline 343 and grounds 341a and 341b which are disposed such that a predetermined gap 345*a* is formed between the ground 341a and the stripline 343 and a predetermined gap 345*b* is formed between the ground 341*b* and the stripline 343. Thus, coplanar lines serving as a feeder line are formed. In the structure of FIG. 27, slots 344*a* and 344*b* each serve as a radiation element.

In each of the above described embodiments, the radiation antenna elements are provided on both sides of the feeder stripline; however, the radiation antenna elements may be provided only on one side of the feeder stripline. Further, the length and pitch of the radiation antenna elements are determined on the basis of the guide wavelength $\lambda_g$ in accordance with required characteristics of the antenna. Each of the radiation antenna elements may have a length n times the length employed in the above-described embodiments (where n is an integer). Moreover, the number of radiation antenna elements connected to the feeder stripline can be determined freely.

What is claimed is:

1. A microstrip array antenna comprising:

a dielectric substrate;

a strip conductor formed on a top face of said dielectric substrate; and a ground plate formed on a reverse face of said dielectric substrate, wherein said strip conductor comprises a straight feeder strip, and a plurality of parallel radiation antenna elements disposed along at least one side of the feeder strip at a predetermined angle relative to the feeder strip and a predetermined pitch, each of said radiation antenna elements having an electric field radiation edge which is not parallel to the longitudinal direction of said feeder strip, said radiation antenna elements dimensioned so that the combination of said radiation antenna elements receives or transmits a linearly polarized electromagnetic wave whose electric field is oriented along a same length of each of said radiation antenna elements, each of said radiation antenna elements has a rectangular shape, a length approximately equal to an integral number multiplied by a half wavelength of the electromagnetic wave which propagates along said feeder strip at a predetermined operated frequency, and a width different from the length and determined according to excitation amplitude of respective radiation antenna elements, said excitation amplitude being determined so as to provide a desired directivity, and is connected to said feeder strip substantially at a comer of said rectangular antenna element.

2. A microstrip array antenna according to claim 1, wherein said electric field radiation edge of each said radiation antenna elements forms an angle of about 45 degrees with respect to said feeder strip.

3. A microstrip array antenna according to claim 1, wherein each of said radiation antenna elements has a rectangular shape in which the length differs from the width.

4. A microstrip array antenna according to claim 1, wherein each of the sides of each of said rectangular radiation antenna elements which form the comer connected to said feeder strip forms an angle of about 45 degrees with respect to the feeder strip.

5. A microstrip array antenna according to claim 1, wherein said radiation antenna elements comprise first radiation antenna elements formed along a first side of said feeder strip and second radiation antenna elements formed along a second side of said feeder strip opposite the first side, the second radiation antenna elements having the same shape as that of the first radiation antenna elements and being disposed substantially in parallel to the first radiation antenna elements.

6. A microstrip array antenna according to claim 5, wherein the first radiation antenna elements formed along the first side of said feeder strip radiate electric fields in a direction substantially parallel to a direction in which the second radiation antenna elements formed along the second side of said feeder strip radiate electric fields.

7. A microstrip array antenna according to claim 5, wherein each of the second radiation antenna elements is disposed at an approximately center point between adjacent first radiation antenna elements disposed along the feeder strip.

8. A microstrip array antenna according to claim 1, wherein said microstrip array antenna is used as at least one of a transmission and a reception antenna.

9. A microstrip array antenna according to claim 5, wherein said microstrip array antenna is used as at least one of a transmission and a reception antenna.

10. A microstrip array antenna according to claim 8, wherein said microstrip array antenna is used as a transmission and/or reception antenna.

11. A microstrip array antenna according to claim 1, wherein said microstrip array antenna is used as at least one of a transmission and a reception antenna of a radar mounted on a vehicle and at least one of radiates and receives an electromagnetic wave which is polarized at an angle of about 45 degrees with respect to a ground surface and of about 90 degrees with respect to a polarized direction of an electromagnetic wave radiated from an oncoming vehicle.

12. A microstrip array antenna according to claim 5, wherein said microstrip array antenna is used as at least one of a transmission and a reception antenna of a radar mounted on a vehicle and at least one of radiates and receives an electromagnetic wave which is polarized at an angle of about 45 degrees with respect to a ground surface and of about 90 degrees with respect to a polarized direction of an electromagnetic wave radiated from an oncoming vehicle.

13. A microstrip array antenna comprising:

a dielectric substrate;

a strip conductor formed on a top face of said dielectric substrate; and a ground plate formed on a reverse face of said dielectric substrate, wherein said strip conductor comprises a straight feeder strip, and a plurality of parallel radiation antenna elements disposed along at least one side of the feeder strip at a predetermined angle relative to the feeder strip and a predetermined pitch, each of said radiation antenna elements having an electric field radiation edge which is not parallel to the longitudinal direction of said feeder strip, said radiation antenna elements dimensioned so that the combination of said radiation antenna elements receives or transmits a linearly polarized electromagnetic wave whose electric field is oriented along a same length of each of said radiation antenna elements, each of said radiation antenna elements has a length approximately equal to an integral number multiplied by a half wavelength of the electromagnetic wave which propagates along said feeder strip at a predetermined operated frequency, and a width determined according to excitation amplitude of respective radiation antenna elements, said excitation amplitude being determined so as to provide a desired directivity, wherein said array antenna has a first region in which each of said radiation antenna elements has a comparatively narrow width and a second region in which each of said radiation antenna elements has a comparatively wide width, said radiation antenna elements in the first region have a strip shape with a constant width and a length larger than the width and are connected to said feeder strip via the entirety of one end of said strip-shaped antenna elements, and said radiation antenna elements in the second region have a rectangular shape in which the length differs from the width and are connected to said feeder strip substantially at a comer of each of said rectangular antenna elements in the second region.

14. A microstrip array antenna according to claim 13, wherein said radiation antenna elements having the strip shape are used in a region in which each of said strip-shaped radiation antenna elements has a width less than about 0.075 times a free-space wavelength at the operating frequency, and said radiation antenna elements having the rectangular shape are used in a region in which each of said rectangular radiation antenna elements has a width equal to or greater than about 0.075 times the free-space wavelength at the operating frequency.

15. A microstrip array antenna according to claim 13, wherein said electric field radiation edge of each of said radiation antenna elements forms an angle of about 45 degrees with respect to said feeder strip.

16. A microstrip array antenna according to claim 13, wherein each of the sides of each of said rectangular radiation antenna elements which form the comer connected to said feeder strip forms an angle of about 45 degrees with respect to the feeder strip.

17. A microstrip array antenna according to claim 15, wherein each of the sides of each of said rectangular radiation antenna elements which form the comer connected to said feeder strip forms an angle of about 45 degrees with respect to the feeder strip.

18. A microstrip array antenna according to claim 13, wherein said radiation antenna elements comprise first radiation antenna elements formed along a first side of said feeder strip and second radiation antenna elements formed along a second side of said feeder strip opposite the first side, the second radiation antenna elements having the same shape as that of the first radiation antenna elements and being disposed substantially in parallel to the first radiation antenna elements.

19. A microstrip array antenna according to claim 18, wherein the first radiation antenna elements formed along the first side of said feeder strip radiate electric fields in a direction substantially parallel to a direction in which the second radiation antenna elements formed along the second side of said feeder strip radiate electric fields.

20. A microstrip array antenna according to claim 18, wherein each of the second radiation antenna elements is disposed at an approximately center point between adjacent first radiation antenna elements disposed along the feeder strip.

21. A microstrip array antenna according to claim 14, wherein said electric field radiation edge of each of said radiation antenna elements forms an angle of about 45 degrees with respect to said feeder strip.

22. A microstrip array antenna according to claim 18, wherein said microstrip array antenna is used as at least one of a transmission and a reception antenna of a radar mounted on a vehicle and at least one of radiates and receives an electromagnetic wave which is polarized at an angle of about 45 degrees with respect to a ground surface and of about 90 degrees with respect to a polarized direction of an electromagnetic wave radiated from an oncoming vehicle.

23. A microstrip array antenna comprising a dielectric substrate, a strip conductor formed on a top face of said dielectric substrate, and a ground plate formed on a reverse face of said dielectric substrate, wherein said strip conductor comprises a straight feeder strip, and a plurality of radiation antenna elements disposed along at least one side of the feeder strip at a predetermined pitch, each of said radiation antenna elements having an electric field radiation edge which is not parallel to the longitudinal direction of said feeder strip, said radiation antenna elements performing at least one of radiating and receiving a linearly polarized electromagnetic wave whose electric field is perpendicular to said electric field radiation edge, each of said radiation antenna elements has a length approximately equal to an integral number multiplied by a half wavelength of the electromagnetic wave which propagates along said feeder strip at a predetermined operated frequency, and a width determined according to excitation amplitude of respective radiation antenna elements, said excitation amplitude being determined so as to provide a desired directivity, said array antenna has a first region in which each of said radiation antenna elements has a comparatively narrow width and a second region in which each of said radiation antenna elements has a comparatively wide width, said radiation antenna elements in the first region have a strip shape with a constant width and a length larger than the width and are connected to said feeder strip via an entirety one end of said strip-shaped antenna element, and said radiation antenna elements in the second region have a rectangular shape in which the length differs from the width and are connected to said feeder strip substantially at the corner of each of said rectangular antenna elements in the second region, said radiation antenna elements having the strip shape are used in a region in which each of said strip-shaped radiation antenna elements has a width less than about 0.075 times the free-space wavelength at operating frequency, and said rectangular radiation antenna elements are used in a region in which each of said rectangular radiation antenna elements has a width equal to or greater than about 0.075 times the free-spaced wavelength at operating frequency, and said radiation antenna elements comprising first radiation antenna elements formed along a first side of said feeder strip and second radiation antenna elements formed along a second side of said feeder strip opposite the first side, the second radiation antenna elements having the same shape as that of the first radiation antenna elements and being disposed substantially in parallel to the first radiation antenna elements.

24. A microstrip array antenna according to claim 23, wherein the first radiation antenna elements formed along the first side of said feeder strip radiate electric fields in a direction substantially parallel to a direction in which the second radiation antenna elements formed along the second side of said feeder strip radiate electric fields.

25. A microstrip array antenna according to claim 23, wherein each of the second radiation antenna elements is disposed at an approximately center point between adjacent first radiation antenna elements disposed along the feeder strip.

26. A microstrip array antenna according to claim 23, wherein said electric field radiation edge of each of said radiation antenna elements forms an angle of about 45 degrees with respect to said feeder strip.

27. A microstrip array antenna according to claim 24, wherein said electric field radiation edge of each of said radiation antenna elements forms an angle of about 45 degrees with respect to said feeder strip.

28. A microstrip array antenna according to claim 25, wherein said electric field radiation edge of each of said radiation antenna elements forms an angle of about 45 degrees with respect to said feeder strip.

29. A microstrip array antenna according to claim 23, wherein said microstrip array antenna is used as at least one of a transmission and a reception antenna.

30. A microstrip array antenna according to claim 23, wherein said microstrip array antenna is used as at least one of a transmission and a reception antenna of a radar mounted on a vehicle and at least one of radiates and receives an electromagnetic wave which is polarized at an angle of about 45 degrees with respect to a ground surface and of about 90 degrees with respect to a polarized direction of an electromagnetic wave radiated from an oncoming vehicle.

* * * * *